US008047883B2

(12) United States Patent
Montalbano et al.

(10) Patent No.: US 8,047,883 B2
(45) Date of Patent: Nov. 1, 2011

(54) WIRE TERMINATION MECHANISMS AND METHODS OF USE

(75) Inventors: Christopher Montalbano, Huntington, NY (US); Gregory Montalbano, Huntington, NY (US); Aaron Klein, Brightwaters, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 12/474,574

(22) Filed: May 29, 2009
(Under 37 CFR 1.47)

(65) Prior Publication Data

US 2010/0304624 A1 Dec. 2, 2010

(51) Int. Cl.
*H01R 4/50* (2006.01)

(52) U.S. Cl. ..... 439/864

(58) Field of Classification Search ..... 439/864, 439/863, 725, 441
See application file for complete search history.

(56) References Cited

U.S. PATENT DOCUMENTS

| | | | | |
|---|---|---|---|---|
| 1,994,880 | A | 3/1935 | Wallbillich | |
| 2,015,858 | A | 10/1935 | Leviton | |
| 2,082,994 | A | 6/1937 | Wallbillich | |
| 2,163,722 | A | 6/1939 | Wallbillich | |
| 2,175,098 | A | 10/1939 | Wertzheiser | |
| 2,201,743 | A | 5/1940 | Petersen | |
| 2,201,751 | A | 5/1940 | Wertzheiser | |
| 2,238,386 | A | 4/1941 | Frank | |
| 2,466,930 | A * | 4/1949 | Cook | 439/656 |
| 2,506,212 | A | 5/1950 | Grohsgal | |
| 2,556,491 | A | 6/1951 | De Lorenzo | |
| 2,763,847 | A * | 9/1956 | Hubbell | 439/736 |
| 2,952,831 | A | 9/1960 | Ehrlich | |
| 3,431,546 | A | 3/1969 | Averill | |
| 3,439,315 | A | 4/1969 | Hamel et al. | |
| 3,660,728 | A * | 5/1972 | Carter | 361/789 |
| 3,713,071 | A | 1/1973 | Poliak et al. | |
| 3,740,613 | A | 6/1973 | Strachan | |
| 3,793,607 | A | 2/1974 | Smith et al. | |
| 3,904,266 | A | 9/1975 | Fitzpatrick | |
| 3,944,314 | A | 3/1976 | Weitzman et al. | |
| 3,945,711 | A | 3/1976 | Hohorst et al. | |
| 3,999,829 | A | 12/1976 | Glaesel | |

(Continued)

FOREIGN PATENT DOCUMENTS

CA 981354 1/1976

(Continued)

OTHER PUBLICATIONS

PCT Notification of Transmittal of the International Search Report and the Written Opinion of the International Searching Authority for PCT/US2007/007596, dated Sep. 10.

(Continued)

*Primary Examiner* — Phuong Dinh
(74) *Attorney, Agent, or Firm* — Carter, DeLuca, Ferrell & Schmidt, LLP

(57) ABSTRACT

The present disclosure relates to wiring terminations. Wiring terminations can be used in any suitable device such as a wiring device. The wiring termination is configured to selectively receive a distal end of a wire therein. The wire termination mechanism includes at least a first position for receiving the distal end of the wire, and a second position for terminating the distal end of the wire against the respective electrical contact upon an actuation thereof from the first position to the second position.

17 Claims, 21 Drawing Sheets

U.S. PATENT DOCUMENTS

| | | | | |
|---|---|---|---|---|
| 4,060,305 | A | 11/1977 | Poliak et al. | |
| 4,099,826 | A | 7/1978 | Mazzeo et al. | |
| 4,172,628 | A | 10/1979 | Lingaraju | |
| 4,255,655 | A | 3/1981 | Kikuchi | |
| 4,296,987 | A | 10/1981 | Lingaraji | |
| 4,372,693 | A | 2/1983 | Lutz | |
| 4,537,560 | A | 8/1985 | Emeterio et al. | |
| 4,759,726 | A | 7/1988 | Naylor et al. | |
| 4,767,340 | A | 8/1988 | Hohorst | |
| 4,793,823 | A | 12/1988 | Cozzens et al. | |
| 4,886,472 | A | 12/1989 | Tsai | |
| 4,995,829 | A | 2/1991 | Geib et al. | |
| 5,015,201 | A | 5/1991 | Brezee et al. | |
| 5,181,310 | A | 1/1993 | Josephson | |
| 5,262,749 | A | 11/1993 | Kopelman | |
| 5,637,011 | A | 6/1997 | Meyerhoefer et al. | |
| 5,825,602 | A | 10/1998 | Tosaka et al. | |
| 5,866,844 | A | 2/1999 | Osterbrock et al. | |
| 5,975,940 | A | 11/1999 | Hartmann et al. | |
| 5,995,350 | A | 11/1999 | Kopelman | |
| 6,049,143 | A | 4/2000 | Simpson et al. | |
| 6,368,149 | B1 * | 4/2002 | Schmidt et al. | 439/519 |
| 6,388,216 | B1 | 5/2002 | Puhalla et al. | |
| 6,406,323 | B2 | 6/2002 | Chung Long Shan | |
| 6,477,021 | B1 | 11/2002 | Haun et al. | |
| 6,689,955 | B2 | 2/2004 | Doutaz | |
| 6,707,652 | B2 | 3/2004 | Engel | |
| 6,712,641 | B2 | 3/2004 | Beege et al. | |
| 6,743,029 | B1 | 6/2004 | Greene et al. | |
| 6,750,402 | B2 | 6/2004 | Geske | |
| 6,786,779 | B2 | 9/2004 | Feldmeier et al. | |
| 6,802,747 | B1 | 10/2004 | Orange | |
| 6,827,602 | B2 | 12/2004 | Greene et al. | |
| 6,861,189 | B1 | 3/2005 | Greene et al. | |
| 6,926,543 | B2 | 8/2005 | Poh et al. | |
| 6,943,310 | B2 | 9/2005 | Eisenhower | |
| 6,948,846 | B2 | 9/2005 | Engel | |
| 7,052,335 | B2 * | 5/2006 | Matsuura et al. | 439/838 |
| 7,097,518 | B2 | 8/2006 | Kraemer et al. | |
| 7,103,968 | B2 | 9/2006 | Karrasch | |
| 7,114,986 | B1 | 10/2006 | Toly | |
| 7,115,001 | B1 | 10/2006 | Brockman et al. | |
| 7,118,404 | B2 | 10/2006 | Ploesser | |
| 7,140,887 | B2 | 11/2006 | Poh et al. | |
| 7,150,646 | B2 | 12/2006 | Trumper | |
| 7,164,082 | B2 | 1/2007 | Kurek et al. | |
| 7,175,485 | B1 | 2/2007 | Alderson et al. | |
| 7,241,188 | B2 | 7/2007 | Lin et al. | |
| 7,249,963 | B2 | 7/2007 | Ramm | |
| 7,270,581 | B2 | 9/2007 | Tiberio | |
| 7,547,226 | B2 | 6/2009 | Koessler | |
| 7,651,363 | B2 | 1/2010 | Koellmann | |
| 2004/0077210 | A1 | 4/2004 | Kollmann | |
| 2005/0090159 | A1 | 4/2005 | Luther et al. | |
| 2005/0212646 | A1 | 9/2005 | Watchorn et al. | |
| 2006/0028316 | A1 | 2/2006 | Fabian et al. | |
| 2006/0288140 | A1 * | 12/2006 | Lin | 710/100 |
| 2007/0026701 | A1 | 2/2007 | Kurek et al. | |
| 2007/0238348 | A1 | 10/2007 | Kopelman | |
| 2008/0013239 | A1 | 1/2008 | Kopelman | |

FOREIGN PATENT DOCUMENTS

| | | | |
|---|---|---|---|
| CA | 1202095 | | 3/1986 |
| CA | 1203591 | | 4/1986 |
| CA | D. 60972 | | 5/1988 |
| DE | 550 863 | C | 5/1932 |
| EP | 01553660 | A1 | 7/2005 |
| EP | 01490928 | B1 | 10/2005 |
| EP | 1608039 | A1 | 12/2005 |
| FR | 2 312 767 | | 12/1976 |
| GB | 2 292 850 | A | 3/1996 |
| GB | 2 393 043 | A | 3/2004 |
| JP | 61 014529 | A | 1/1986 |
| WO | WO 97/03480 | | 1/1997 |

OTHER PUBLICATIONS

PCT International Search Report for PCT/US/2007/009433 dated Dec. 20, 2007.

Wago Innovative Connections, Wago Main Selection Page, www.connex-electronics.com/html/products/wago_main_select.html.

Wago Innovative Connections, The Wago Cage Clamp Technology, Electrical Interconnections.

Wago Innovative Connections, 773 Pushwire Connectors, For 10 AWG, Electrical Interconnections.

Wago Innovative Connections, LEVER-NUTS, 222 Series: 3 or 5 COnductor Compact Connectors, Electrical Interconnections.

* cited by examiner

WIRE TERMINATION MECHANISMS AND METHODS OF USE

BACKGROUND

1. Technical Field

The present disclosure relates to wiring devices and, more particularly, to wiring devices having novel wire termination mechanisms and related methods of use thereof.

2. Description of Related Art

To route, install and otherwise use AC electrical power, manufactures produce many different kinds of devices. These devices are referred to herein as wiring devices. Examples of wiring devices include electrical receptacles, switches, dimmers, occupancy sensors, lighting fixtures, ground/arc fault circuit interrupters, and the like. Wiring devices are connected to the AC electrical power via wires/conductors (the terms wire and conductor may be used hereinafter synonymously), which can include solid core conductors and/or stranded wire conductors. A wire includes (or is considered to be) a conductive path for carrying the AC electrical power.

Wiring devices typically include wire termination terminals for terminating wires. Terminal types typically found on wiring devices include sets of line and load terminals and/or ground terminals. Each set of line and/or load terminals typically comprise individual phase and neutral terminals. Together these terminals, depending on the mechanical configuration, may be wired using one or more of several different common termination mechanisms/techniques where the mechanical configuration of the termination mechanisms typically dictates the technique used.

One such termination mechanism/technique is commonly referred to as "side-wire" (or otherwise referred to as "wrap-wire"). To terminate a wire using a side-wire terminal, an end of the wire is initially stripped to expose at least a portion of the end of the wire and then this exposed portion is wrapped around a terminal screw. The terminal screw is then tightened causing the head of the screw to secure the exposed wire between the head of the screw and a metallic plate (e.g., a brass terminal).

Another type of wiring mechanism/technique is referred to as "back-wire" (otherwise also referred to as "clamp-wire"). Typically, in back-wire terminals a screw engages a metallic plate with a second metallic plate (the resulting arrangement forming in a clamp) to compress a wire therebetween. In such a back-wire termination mechanism, a first metallic plate typically has a threaded opening and forms the clamp arrangement with a second metallic plate that has a non-threaded opening sized large enough to allow this second metallic plate to slide along the shaft of the screw between the first metallic plate and the head of the screw. Placing an exposed end of a stripped wire between the two metallic plates and tightening the screw results in the wire being removably secured between the two plates.

Another type of wiring terminal mechanism/technique is referred to as "push in". Push-in termination mechanisms typically comprise a small hole, or aperture, in the wiring device housing through which an exposed end of a stripped wire is inserted and removably secured within the wiring device with the cooperation of a retention mechanism. For example, an end of a solid-core wire is initially stripped to expose about five-eighths of an inch of the wire core. The resultant exposed portion of the wire is then inserted through the hole and into engagement with the internal retention mechanism which removably secures the exposed end of the wire by, e.g., applying clamping pressure to the wire in order to maintain the wire in electrical contact with an internal conductive portion of the wiring device. The retention mechanism provides sufficient resistance to prevent the wire from being pulled out of the hole. Typically, to release the wire, a tool (e.g., a screwdriver) is used to engage a releasing mechanism to release the wire.

Wiring devices usually also include a ground terminal that typically uses a wrap-wire/side-wire arrangement, as described above; e.g., a metallic plate that includes a threaded opening for receiving a ground terminal screw. Grounded wiring devices could also employ a conductive strap, or frame, that may be used in conjunction with a ground terminal screw for grounding the device. Wiring devices that use such a ground terminal screw in a side-wire/wrap-wire configuration would be wired as discussed above using an exposed portion of the ground wire.

In view of the foregoing, it is desirable for wiring devices that include more convenient termination mechanisms, and methods of use thereof, to facilitate installation and use of typical wiring devices.

SUMMARY

According to an aspect of the present disclosure, a wiring device is provided and includes a housing having at least one aperture configured to receive a distal end of a wire therein, the aperture being in registration with a wire path; an electrical contact at least partially disposed within the housing and in registration with the wire path; and a wire termination mechanism comprising a body portion having an axis of rotation and at least one eccentric cam portion, the wire termination mechanism being rotationally supported by the housing and at least partially disposed therein. The wire termination mechanism is configured to selectively secure the distal end of the wire and includes at least a first position in which the wire termination mechanism allows the insertion or removal of the wire and at least a second position in which the wire termination mechanism secures the wire in electrical communication with the electrical contact.

Each wire termination mechanism terminates the distal end of the wire upon approximately a ¼ to approximately a ½ revolution.

The wiring device further includes a collet in registration with each aperture. Each collet is configured to support a distal end of a wire inserted therein.

According to another aspect of the present disclosure, a wiring device is provided and includes a housing defining at least one aperture configured to selectively receive a distal end of a wire therein; and at least one wire termination mechanism rotatably supported by the housing for selectively securing the distal end of the wire to the wiring device. The wire termination mechanism includes a cam having a body portion defining an axis of rotation extending in a direction transverse to an insertion axis of the at least one aperture; and at least one eccentric cam portion supported on the body portion of the cam and in registration with the at least one aperture. The cam portion is movable to and away from the at least one aperture upon a rotation of the body portion.

According to a further aspect of the present disclosure, a method of terminating a wire to a wiring device is provided and includes the steps of inserting a distal end of the wire into an aperture of the wiring device; and rotating a wire termination mechanism having a cam portion to a securing position. The rotation of the wire termination mechanism causes a surface of the cam portion to selectively engage the distal end of the wire and establish electrical communication between the wire and the wiring device.

The step of rotating may include rotating the wire termination mechanism approximately a ¼ to ½ revolution.

According to still another aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism at least partially disposed within the housing and extending across the pair of apertures. The wire termination mechanism is configured to simultaneously selectively secure the distal end of each wire upon a rotation thereof. The wire termination mechanism includes at least a first position in which the wire termination mechanism allows the insertion or removal of the wires and at least a second position in which the wire termination mechanism secures the wires in electrical communication with the electrical contact.

According to yet another aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism supported on the housing, the wire termination mechanism including a bridge member extending across the pair of apertures and a rotation member for displacing the bridge member toward the housing. The wire termination mechanism is configured to simultaneously selectively secure the distal end of each wire upon a rotation of the rotation member. The wire termination mechanism includes at least a first position in which the bridge member of the wire termination mechanism does not extend into each path and thus allows the insertion or removal of the wires, and at least a second position in which the bridge member of the wire termination mechanism extends into each wire path and secures the wires in electrical communication with the electrical contact.

According to a further aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism at least partially disposed within the housing. The wire termination mechanism includes a ring member extending between the pair of apertures and a rotation member disposed within the ring member for displacing portions of the ring member toward the wire paths. The wire termination mechanism is configured to simultaneously selectively secure the distal end of each wire upon a rotation of the rotation member. The wire termination mechanism includes at least a first position in which the rotation member flexes the ring member of the wire termination mechanism so as to not extend into each path and thus allows the insertion or removal of the wires, and at least a second position in which the rotation member flexes the ring member of the wire termination mechanism so as to extend into each wire path and secures the wires in electrical communication with the electrical contact.

According to another aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism supported on the housing, the wire termination mechanism including an arm associated with each aperture and a rotation member for displacing the arm toward the respective aperture of the housing. Each arm includes a finger configured to engage the distal end of each wire upon displacement of the arm during a rotation of the rotation member. The wire termination mechanism includes at least a first position in which the finger of each arm does not extend into each path and thus allows the insertion or removal of the wires, and at least a second position in which the finger of each arm of the wire termination mechanism extends into each wire path, engaging the distal end of the respective wire and securing the respective wire in electrical communication with the electrical contact.

According to yet another aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism supported on the housing. The wire termination mechanism includes a bridge member extending between the pair of apertures and a rotation member for displacing the bridge member toward the housing. The bridge member includes fingers extending therefrom for engagement with ramping surfaces provided in the housing and in registration with respective apertures. The wire termination mechanism is configured to simultaneously selectively secure the distal end of each wire upon a rotation of the rotation member. The wire termination mechanism includes at least a first position in which the fingers of the bridge member of the wire termination mechanism do not extend into the respective wire paths and thus allows the insertion or removal of the wires, and at least a second position in which the fingers of the bridge member of the wire termination mechanism are cammed by the ramping surface to extend into each respective wire path and secure a respective wire into electrical communication with the electrical contact.

According to still another aspect of the present disclosure, a wiring device is provided and includes a housing defining at least a pair of apertures each configured to receive a distal end of a wire therein, each aperture being in registration with a wire path; an electrical contact at least partially disposed within the housing and in registration with each wire path; and a wire termination mechanism pivotally supported on the housing. The wire termination mechanism includes a lever extending across the pair of apertures. The wire termination mechanism is configured to selectively secure the distal end of each wire upon a clamping of the lever against the housing. The lever of the wire termination mechanism includes at least a first position in which the lever does not extend into each path and thus allows the insertion or removal of the wires, and at least a second position in which the lever of the wire termination mechanism extends into each wire path and clamps the wires into electrical communication with the electrical contact.

According to a further aspect of the present disclosure, a wiring device is provided and includes a housing defining an aperture configured to receive a distal end of a wire therein, the aperture being in registration with a wire path; an electrical contact at least partially disposed within the housing and in registration with the wire path; and wire termination means at least partially disposed within the housing for selectively securing the distal end of the wire. The wire termination means includes at least a first position in which the wire termination means allows the insertion or removal of the wire and at least a second position in which the wire termination means secures the wire in electrical communication with the electrical contact.

According to another aspect of the present disclosure, a wire termination mechanism for terminating a wire to a wiring device is provided and includes a body portion having an axis of rotation and at least one eccentric cam portion. The wire termination mechanism is rotationally supported in the wiring device. The wire termination mechanism is configured to selectively secure a distal end of the wire and includes at least a first position in which the wire termination mechanism allows the insertion or removal of the wire into/from the wiring device and at least a second position in which the wire termination mechanism secures the wire in electrical communication with an electrical contact of the wiring device.

According to still another aspect of the present disclosure, a wire termination mechanism for selectively securing a distal end of a wire to a wiring device is provided and includes a cam having a body portion defining an axis of rotation extending in a direction transverse to an insertion axis of an aperture of the wiring device configured to receive the distal end of the wire; and at least one eccentric cam portion supported on the body portion of the cam and in registration with the at least one aperture, wherein the cam portion is movable to and away from the at least one aperture upon a rotation of the body portion.

These and other features and advantages of the present disclosure will be understood upon consideration of the following detailed description and the accompanying drawings.

BRIEF DESCRIPTION OF THE DRAWINGS

These and other advantages and aspects will become more apparent from the following detailed description of the various embodiments of the present disclosure with reference to the drawings wherein:

FIG. 23B is a schematic side view of the alternate wire termination mechanism of FIG. 23A illustrating the termination of the stripped ends of wires in the wiring device;

DETAILED DESCRIPTION OF EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
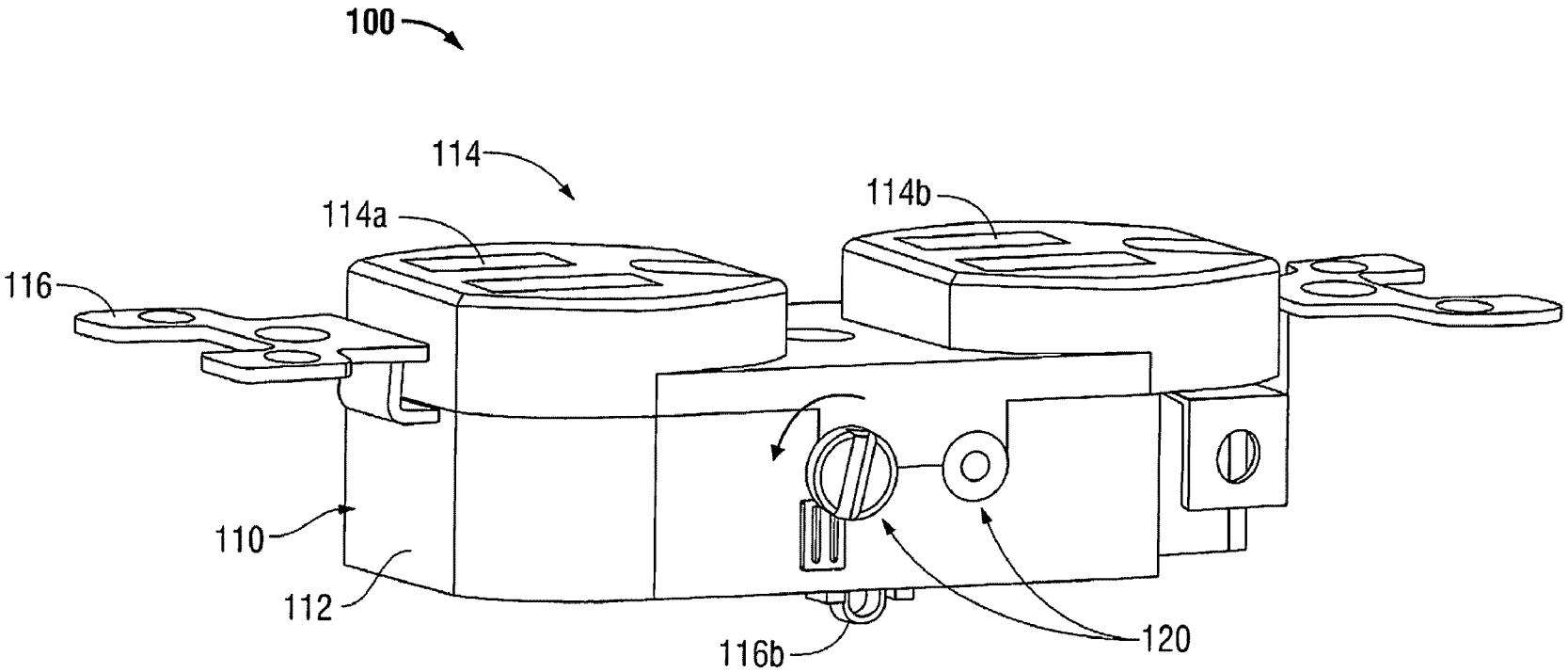
FIG. 1 is top, perspective view of a wiring device including a wire termination mechanism according to an embodiment of the present disclosure.
Figure 2:
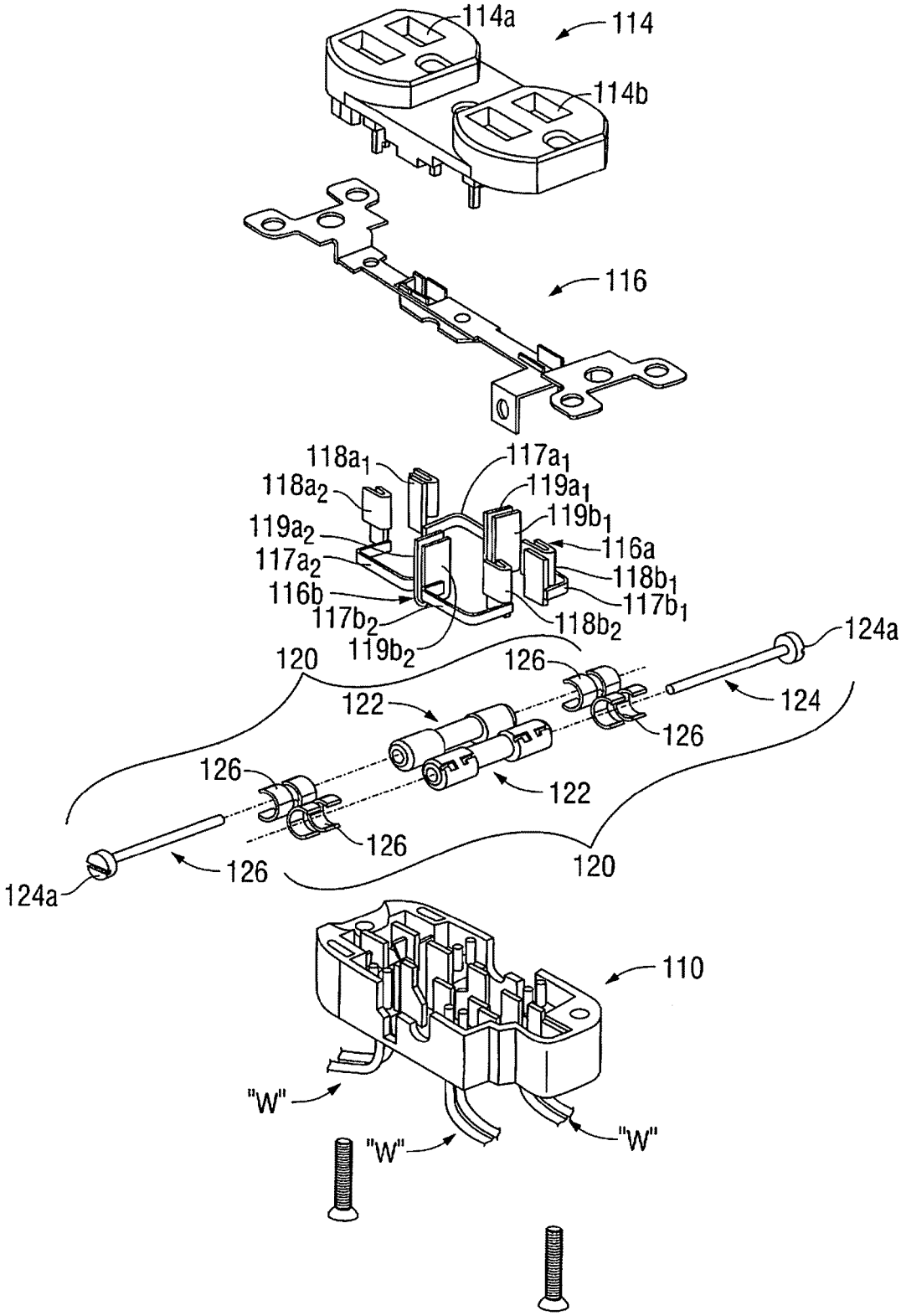
FIG. 2 is an exploded, perspective view of the wiring device of FIG. 1.

Referring now to the figures, and in particular to FIGS. 1-2, a wiring device, including at least one wire termination mechanism according to an embodiment of the present disclosure, is generally designated as 100. Wiring device 100 is in the form of an electrical receptacle, in particular, a duplex three-prong electrical receptacle for handling 15 amp current applications. However, it should be understood that the term "wiring device" is intended to include any of the standard electrical devices that are available including but not limited to switches, lighting fixtures, ground/arc fault circuit interrupters (GFCI/AFCI), dimmers, communication devices, fan speed controls, occupancy sensors, energy management devices, surge suppressors, and the like.

As seen in FIGS. 1-2, wiring device 100 includes a housing 110 having a base portion 112 and a cover portion 114 configured and dimensioned for connection to and support on base portion 112. Wiring device 100, as shown, includes a mounting/grounding strap 116 disposed between base portion 112 and cover portion 114 (while not shown, in alternative configurations the mounting/grounding strap can wrap around the back of the device). Mounting strap 116 extends across upper and lower apertures 112*a*, 112*b*, respectively, formed in base portion 112, and across upper and lower pair of blade openings 114*a*, 114*b*, respectively, formed in cover portion 114.

As seen in FIG. 2, wiring device 100 includes at least one electrical contact supported in housing 110 and in registration with blade openings 114*a*, 114*b*. In particular, wiring device 100 includes a pair of upper electrical contacts $\mathbf{118}a_1$, $\mathbf{118}a_2$ in registration with the upper pair of blade openings 114*a*, and a pair of lower electrical contacts $\mathbf{118}b_1$, $\mathbf{118}b_2$ in registration with the lower pair of blade openings 114*b*. Preferably, wiring device 100 further includes at least one electrical terminal $\mathbf{119}a_1$, $\mathbf{119}a_2$ $\mathbf{119}b_1$, $\mathbf{119}b_2$ for each respective electrical contact $\mathbf{118}a_1$, $\mathbf{118}a_2$, $\mathbf{118}b_1$, $\mathbf{118}b_2$, as shown in FIG. 2. Additionally, wiring device 100 includes a conductive path $\mathbf{117}a_1$, $\mathbf{117}a_2$ $\mathbf{117}b_1$, $\mathbf{117}b_2$ electrically interconnecting or bridging a respective electrical terminal $\mathbf{119}a_1$, $\mathbf{119}a_2$ $\mathbf{119}b_1$, $\mathbf{119}b_2$ to a respective electrical contact $\mathbf{118}a_1$, $\mathbf{118}a_2$, $\mathbf{118}b_1$, $\mathbf{118}b_2$.

Figure 4:
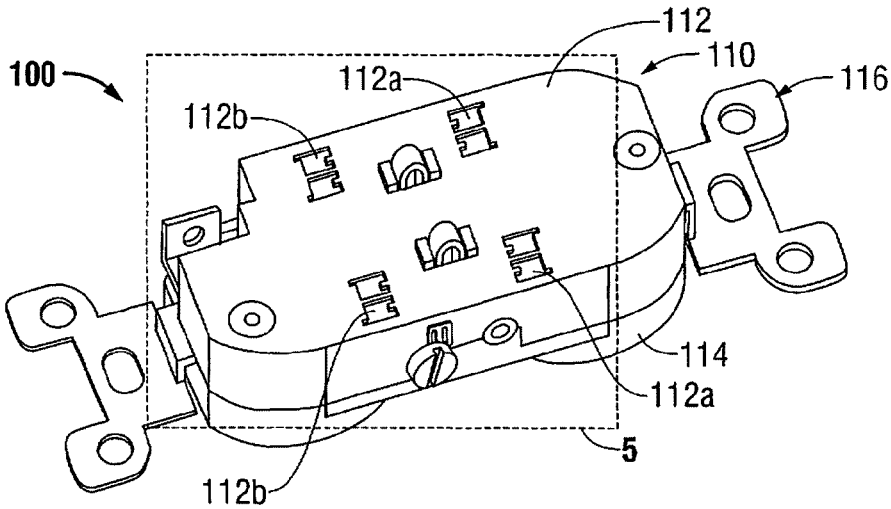
FIG. 4 is a bottom, perspective view of the wiring device of FIGS. 1-3.
Figure 5:
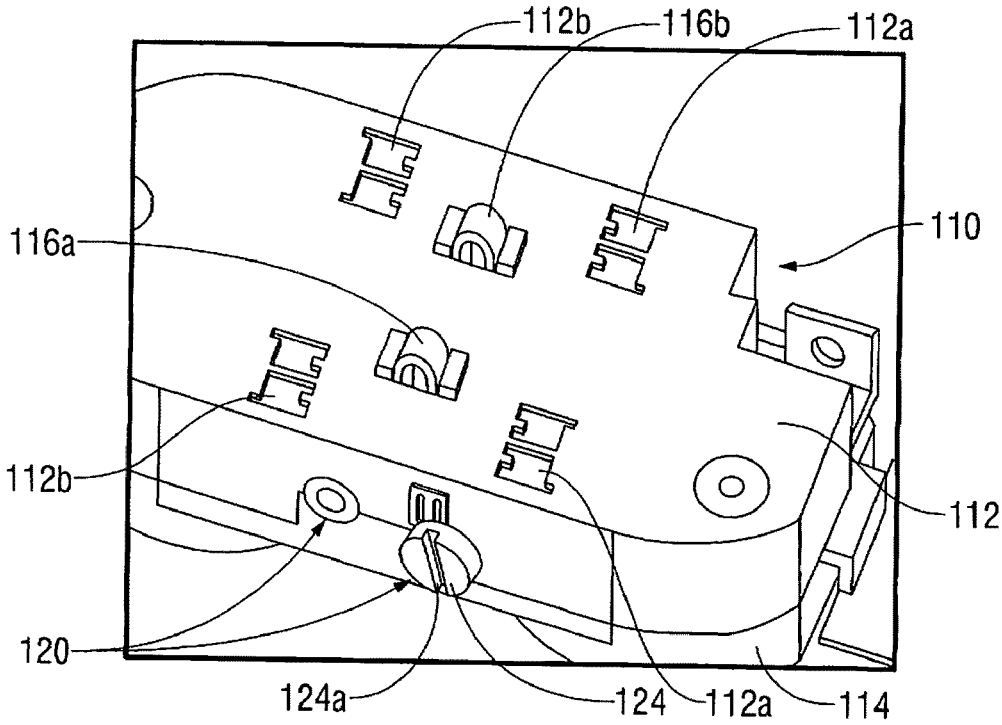
FIG. 5 is an enlarged view of the indicated area of detail of FIG. 4, illustrating breakaway tabs of the wiring device shown in place.
Figure 6:
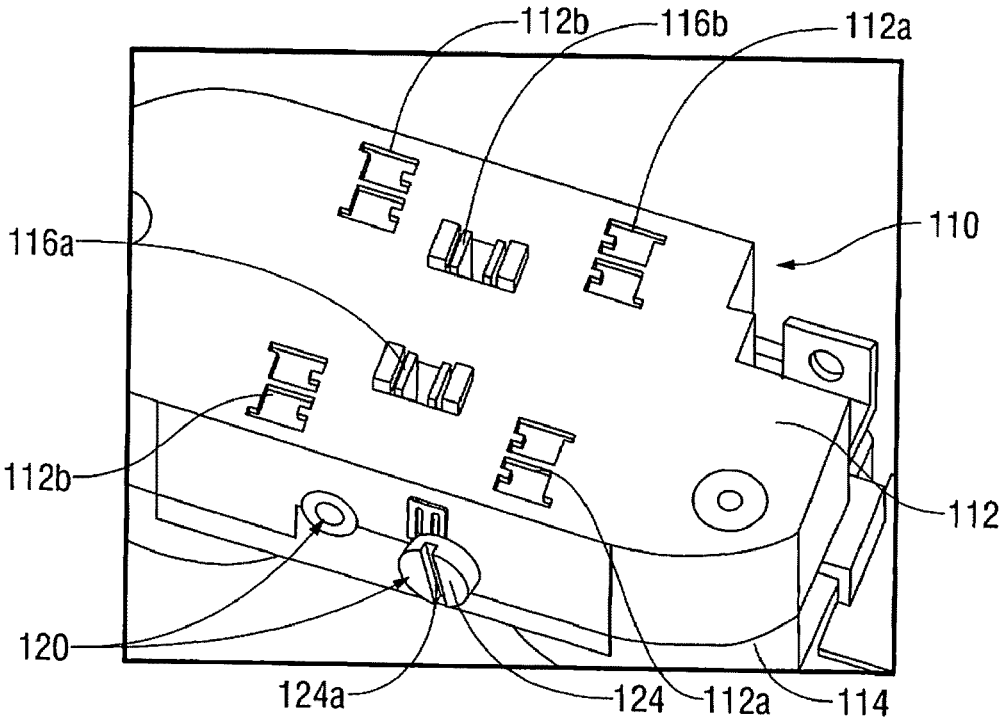
FIG. 6 is the enlarged view of FIG. 5, illustrating the breakaway tabs of the wiring device removed.

With continued reference to FIGS. 1-2, wiring device 100 includes at least one wire termination mechanism 120 supported in housing 110. With particular reference to FIGS. 1-2, in one preferred embodiment, a pair of wire terminating mechanisms 120 is provided such that a wire termination mechanism 120 may be provided for operative association with each pair of upper and lower apertures 112*a*, 112*b* of base portion 112, as seen in FIG. 4. Wire termination mechanisms 120 enable a user to more conveniently, e.g., more quickly and/or efficiently, terminate wires "W" to wiring device 100. Each wire termination mechanism 120 includes at least a first, open position in which wires "W" may be introduced or inserted into wiring device 100, and at least a second, closed position in which wires "W" are prevented or inhibited from being withdrawn or detached from wiring device 100; i.e., wires "W" are maintained and/or terminated in wiring device 100 in accordance with applicable electrical codes/standards. When wires "W" are terminated in wiring device 100, wires "W" are placed into electrical communications with a respective electrical contact $\mathbf{118}a_1$, $\mathbf{118}a_2$, $\mathbf{118}b_1$, $\mathbf{118}b_2$. A more detailed discussion of the construction and operation of wire termination mechanisms 120 is provided below.

As seen in FIGS. 4-7, in one preferred embodiment wiring device 100 may include a set of upper and lower apertures 112*a*, 112*b* formed in base portion 112, respectively. Upper and lower apertures 112*a*, 112*b* are preferably adapted and configured to receive wires "W" therein, including in certain embodiments being adapted and configured to selectively receive wires of predefined gauges. In further embodiment, apertures 112*a*, 112*b* are may also be configured to be in substantial alignment/registration with respective blade openings 114*a*, 114*b* formed in cover portion 114.

As shown in FIGS. 4-7, wiring device 100 may include a pair of break away tabs 116*a*, 116*b*, wherein a first tab 116*a* of the pair of break away tabs is in electrical contact with right side upper electrical terminal 119$a_1$ and right side lower electrical terminal 119$b_1$ supported in housing 110 (for electrically interconnecting upper electrical contact 118$a_1$ and right side lower electrical terminal 118$b_1$ with one another), and a second tab 116*b* of the pair of break away tabs is electrical contact with left side upper electrical terminal 119$a_2$ and left side lower electrical terminal 119$b_2$ supported in housing 110 (for electrically interconnecting the left side upper electrical contact 118$a_2$ and left side lower electrical contact 118$b_2$ with one another).

By providing wiring device 100 with break away tabs 116*a*, 116*b*, upper and lower receptacle portions can be linked or separated from one another by either maintaining or removing either or both break away tabs 116*a*, 116*b*. For example, if desired, the installer may leave in place break away tab 116*a* to thereby maintain right side upper electrical contact 118$a_1$ and right side lower electrical contact 118$b_1$ in electrical contact with one another, and thus upper and lower blade openings 114*a*, 114*b*, disposed along the right side of the wiring device, in electrical communication with one another. Additionally, or alternatively, if desired the installer may leave in place break away tab 116*b* to thereby maintain left side upper electrical contact 118$a_2$ and left side lower electrical contact 118$b_2$ in electrical contact with one another, and thus upper and lower blade openings 114*a*, 114*b*, disposed along the left side of the wiring device, in electrical communication with one another.

Alternatively, if desired, the installer may remove break away tab 116*a* to thereby electrically isolate right side upper electrical contact 118$a_1$ and right side lower electrical contact 118$b_1$ and/or remove break away tab 116*b* to thereby electrically isolate left side upper electrical contact 118$a_2$ and left side lower electrical contact 118$b_2$ of the wiring device 100. It may be desired for both tabs 116*a* and 116*b* to be broken away, thereby resulting in the upper receptacle being isolated from the lower receptacle so that, e.g., the lower receptacle may have uninterrupted power (as is typical), and the upper receptacle may be switched via a wall switch (as is often done in, for example, bedrooms and outlets used for nightlights/nightstands).

Figure 3A:
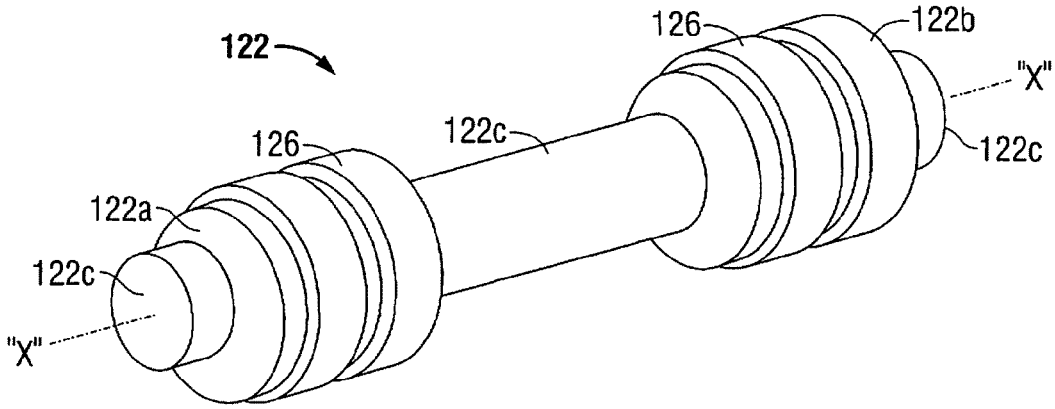
FIG. 3A is an enlarged perspective view of a component of the wire termination mechanism of the wiring device of FIG. 3.
Figure 3B:
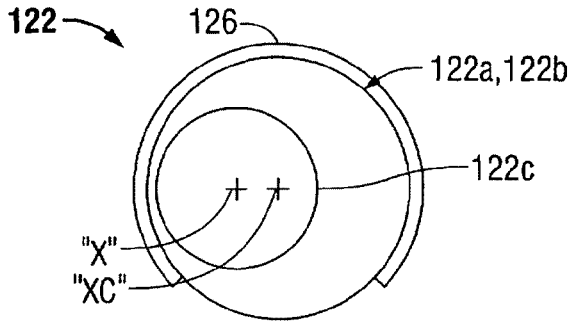
FIG. 3B is a side, elevational view of the component shown in FIG. 3A.

Referring now to FIGS. 1-3B and 7-12, a more detailed discussion of the construction and operation of one preferred embodiment of wire termination mechanisms 120 is provided. As seen in FIGS. 3-3B, cam 122 of each wire termination mechanism 120 includes a pair of eccentric cam barrels or members 122*a*, 122*b* rotatably supported in housing 110, wherein one cam portion 122*a*, 122*b* is in operative association with respective upper and lower apertures 112*a*, 112*b* of base portion 112 and respective upper and lower eyelets 114*a*, 114*b* of cover portion 114. Each cam portion 122*a*, 122*b* defines an axis of rotation "X" (see FIGS. 3A and 3B) that is transverse to an axis of apertures 112*a* of base portion 112 (in other embodiments, it is contemplated that the axis of rotation "X" does not need to be transverse to an axis of apertures 112*a* of base portion 112). The axis of rotation "X" of wire termination mechanism 120 is offset a radial distance from a central axis "XC" (see FIG. 3B) of cam portions 122*a*, 122*b*. In this manner, as wire termination mechanism 120 is rotated about the axis of rotation "X", an outer surface of cam portions 122*a*, 122*b* is moved closer to or further from the axis of respective apertures 112*a* in accordance with the cam shape associated with the cam barrels 122*a*, 122*b*. In one embodiment, it is contemplated that wire termination mechanisms 120 are positioned within housing 110 and dimensioned such that rotation of cam portions 122*a*, 122*b* about the axis of rotation "X," of wire termination device 120, causes an outer surface thereof to extend into and out of the path of apertures 112*a* of base portion 112. In this manner, if a wire "W" is present in an aperture 112*a*, 112*b*, as wire termination mechanism 120 is rotated about the axis of rotation "X," an outer surface of cam portions 122*a*, 122*b* will come into and out of electrical contact with wire "W." In an alternative embodiment, an appropriately sized and configured wire termination mechanism 120 could be provided for each associated aperture 112*a*, 112*b* (i.e., four individually operable wire termination mechanisms 120).

A cam is herein understood to be a structure having a periphery with at least two different points or areas along the periphery, with each point or area having a different radius from the rotational axis. Cams or cam portions utilizable in accordance with the present disclosure can be any suitable shape (e.g., triangular, oblong, tear drop and the like).

It is contemplated that wire termination mechanism 120 includes a cam 122 having central cylindrical body portion, or shaft, 122*c*, a cylindrical first cam portion 122*a* supported on body portion 122*c*, and a second cylindrical cam portion 122*b* supported on body portion 122*c*. It is first and second cam portions 122*a*, 122*b* that define a common central axis "XC," and it is the body portion 122*c* that defines the axis of rotation "X". As mentioned above, the axis of rotation "X" of body portion 122*c* is spaced a radial distance from the central axis first and second cam portions 122*a*, 122*b*. Accordingly, as wire termination mechanism 120 is rotated about body portion 122*c*, and thus the axis of rotation "X," an outer surface of the first and second cam portions 122*a*, 122*b* enters into and out of a path of respective upper and lower apertures 112*a*, 112*b* of base portion 112. In one preferred embodiment, it is contemplated that wire termination mechanism 120 may be rotated approximately a ¼ turn (or revolution, e.g., about 90° to approximately a ½ turn (or revolution, e.g., about 180° to effectuate contact of cam portions 122*a*, 122*b* with wires "W" to removably secure wires "W" to the wiring device. While the embodiment as shown is rotated by approximately ¼ to ½ turn or revolution, any suitable degree of rotation may be used.

In one preferred embodiment, each wire termination mechanism 120 may include a rotation member 124 disposed externally of housing 110 and connected to a respective cam portion 122 in order to effectuate rotation of cam portion 122 upon rotation thereof. In particular, rotation member 124 is preferably keyed to body portion 122*c* such that rotation of rotation member 124, relative to housing 110, results in a corresponding rotation of body portion 122*c* and, in turn, cam portions 122*a*, 122*b* relative to housing 110. Alternatively, rotation member 124 may be integral with cam portion 122, or even with wire termination mechanism 120 as a whole; i.e., a single, unitary construction.

By way of example only, rotation member 124 may have a head 124*a* in the form of a screw head having a slot 124*b* or other tool engaging feature. In this manner, a tool (e.g., screw driver, hex key, or the like) may engage rotation member 124 and facilitate rotation thereof It is further contemplated that head 124*a* of rotation member 124 may be user actuatable without any tools, i.e., by hand/fingers (e.g., rotation member 124 may have a knurled outer surface, be in the form of a "thumb-screw," or the like).

Figure 8:
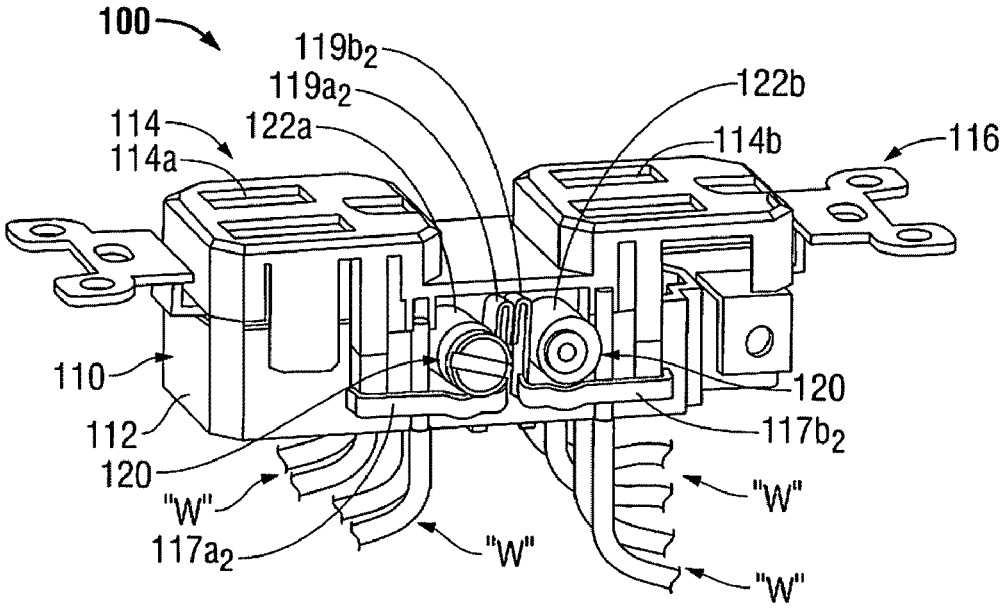
FIG. 8 is a break-away view of the wiring device of FIGS. 1-7, illustrating the wire termination mechanisms engaged with the wires.
Figure 10:
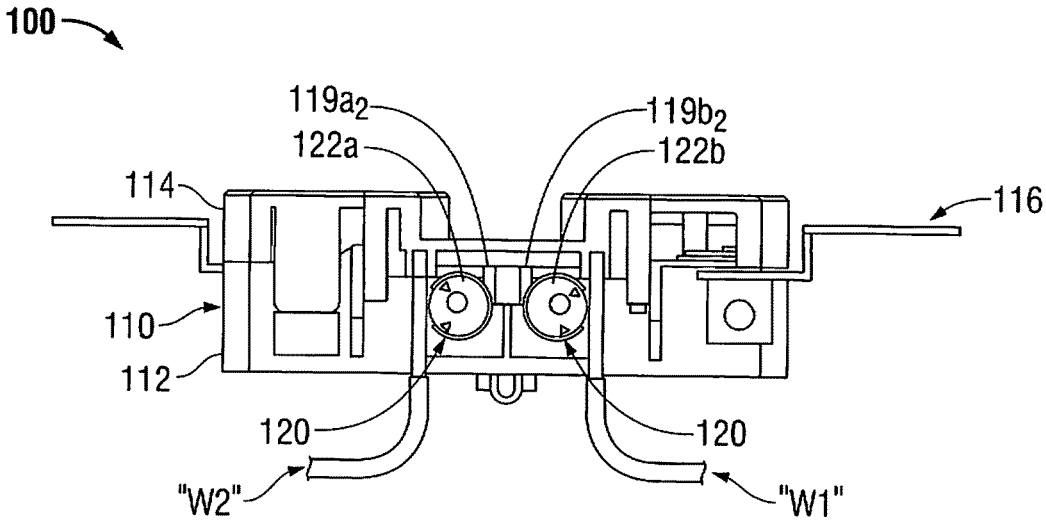
FIG. 10 is a side, elevational view of the wiring device of FIGS. 1-9, illustrating the wire termination mechanisms disengaged from the wires.
Figure 11:
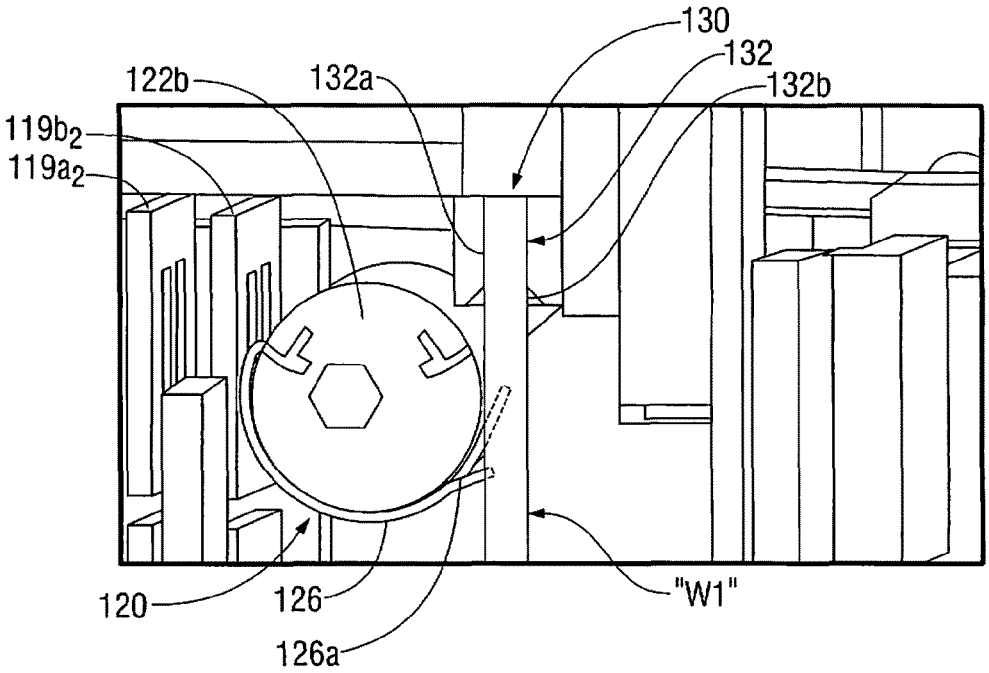
FIG. 11 is an enlarged view of the indicated area of detail of FIG. 9, illustrating the insertion of a relatively thinner wire into the wiring device.
Figure 12:
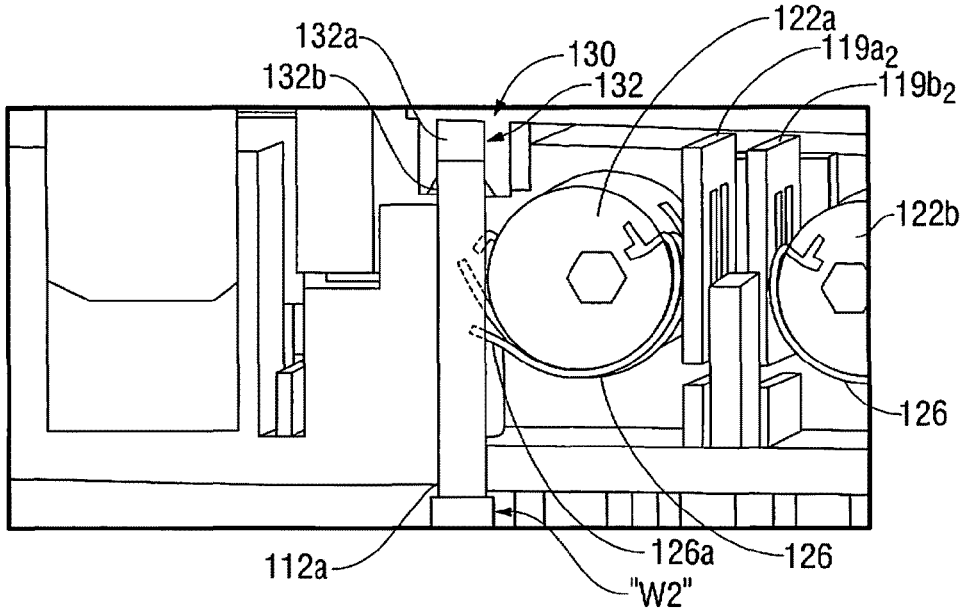
FIG. 12 is an enlarged view of the indicated area of detail of FIG. 9, illustrating the insertion of a relatively thicker wire into the wiring device.

As seen in the illustrative embodiments shown in FIGS. 8, 11 and 12, each cam portion 122*a*, 122*b* could preferably include a contact cuff 126 secured to an outer surface thereof. It is contemplated that each contact cuff 126 extends radially and/or axially along a portion of the outer surface of respective cam portions 122*a*, 122*b*. Each contact cuff 126 could be properly dimensioned to provide electrical isolation between a distal end of a wire "W" positioned within a respective aperture 118$a_1$, 118$a_2$, 118$b_1$, 118$b_2$ and a respective electrical terminal 119$a_1$, 119$a_2$, 119$b_1$, 119$b_2$, when wire termination mechanism 120 is in the first position (as seen in FIG. 10), and to establish an electrical connection between or electrically bridge a distal end of a wire "W" positioned within a respective aperture 118$a_1$, 118$a_2$, 118$b_1$, 118$b_2$ and a respective electrical terminal 119$a_1$, 119$a_2$, 119$b_1$, 119$b_2$, when the wire termination mechanism 120 is in the second position, e.g., electrically terminating the wires "W" (as seen in FIGS. 11 and 12). Additionally, contact cuff 126 could also be properly adapted and configured to enhance operation of the wire termination mechanism so as to provide increased resistance to wires "W" being undesirably pulled out of wiring devices.

As seen in FIG. 3B, it is contemplated that each contact cuff 126 may be supported on respective cam portions 122*a*, 122*b* such that contact cuff 126 extends radially along an outer surface of the cam portion 122*a*, 122*b* an amount sufficient for a forward end and a rearward end thereof to both extend across a plane defined by the axis of rotation "X" of cam 122 and the central axis "XC" of cam portions 122*a*, 122*b*. It is further contemplated that contact cuff 126 extends at least 180°, and in an embodiment approximately 270°, around cam portions 122*a*, 122*b*.

In one embodiment, contact cuff 126 could be adapted and configured to include at least one barb-like member 126*a*, or the like, projecting outwardly from a surface thereof. Barbs 126*a* could be adapted and configured to project tangentially from an outer surface thereof or in any other suitable arrangement. Further, barbs 126*a* could preferably be oriented in a direction so as to engage wire "W" when it is positioned within the respecting apertures 112*a*, 112*b* of base portion 112, and draw wire "W" further into apertures 112*a*, 112*b* as cam portions 122*a*, 122*b* are rotated/actuated.

Figure 15B:
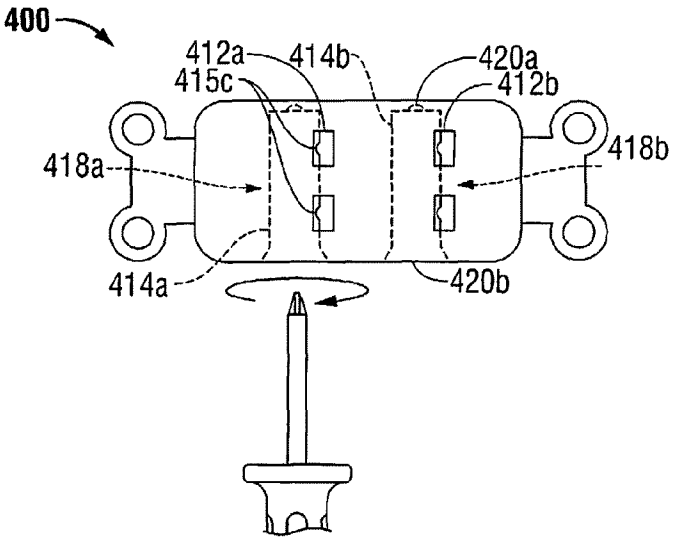
FIG. 15B is a schematic bottom view of the alternate wire termination mechanism for a wiring device as shown in FIG. 15A.
Figure 15D:
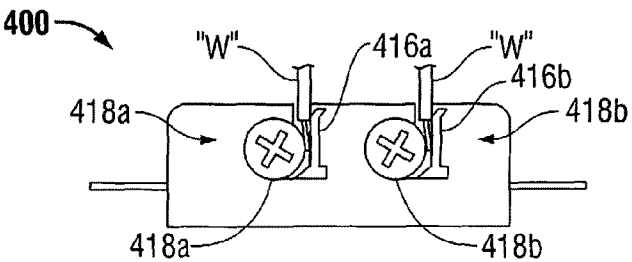
FIG. 15D is a schematic illustrating insertion and termination of a stripped wire into the wiring device of FIGS. 15A-15C.

In certain embodiments, it is contemplated that contact cuff 126 may be fabricated from an electrically conductive material so as to establish an electrical connection with wire "W." Alternatively, if cam portions 122*a*, 122*b* are fabricated from an electrically conductive material, cuffs 126 may be configured to grip wire "W" along its sides, or longitudinal axis, and allow for the surface of wire "W" (juxtaposed to cam portions 122*a*, 122*b*) to contact cam portions 122*a*, 122*b* as wire termination mechanism 120 is rotated; e.g., cuff 126 may be adapted and configured to include grooves or channels (see, e.g., inset of FIG. 15*b*). Alternatively, contact cuff 126 may be eliminated as a separate piece, i.e., fabricated as a unitary part of cam portions 122*a*, 122*b*.

Figure 7:
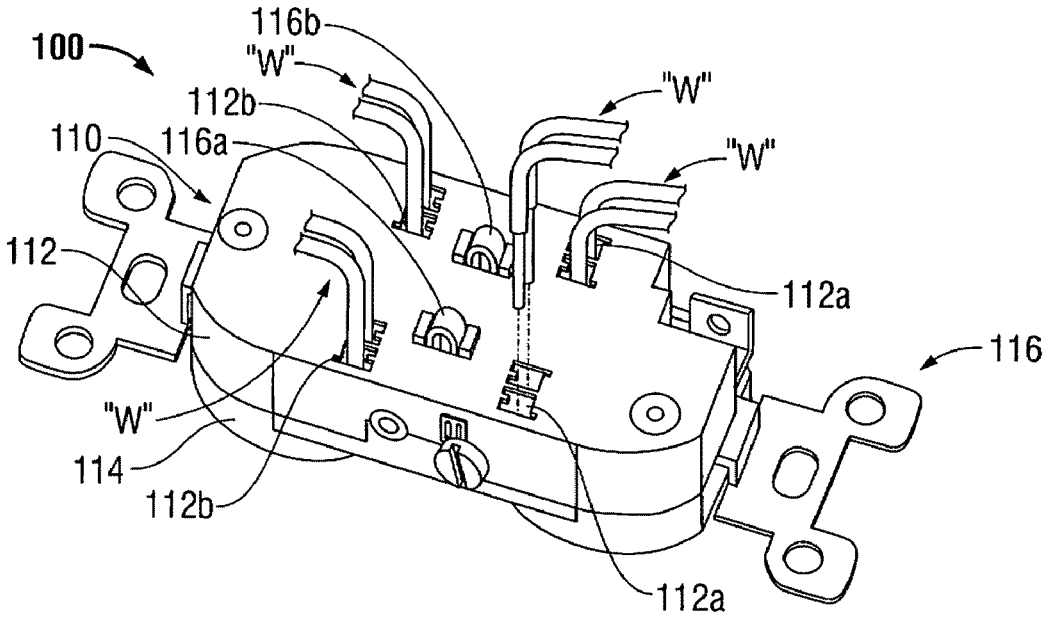
FIG. 7 is a bottom, perspective view of the wiring device of FIGS. 1-3, illustrating insertion of wires into discrete wire cavities of the wiring device.

In operation, with wire termination member 120 in a first position, as seen in FIG. 7, wires "W" are inserted into apertures 112*a*, 112*b* of base portion 112 of housing 100. With wires "W" positioned within apertures 112*a*, 112*b* of base portion 112, each respective wire termination member 120 is rotated (as indicated by arrow "A" of FIG. 1) to urge or rotate the outer surface of cam portions 122*a*, 122*b* thereof into electrical contact with wires "W."

Each wire termination mechanism 120 includes at least a first, open position in which wires "W" may be introduced or inserted into wiring device 100, and at least a second, closed position in which wires "W" are prevented or inhibited from being withdrawn or detached from wiring device 100 under certain prescribed conditions, e.g., in accordance with local electrical codes/standards.

Figure 9:
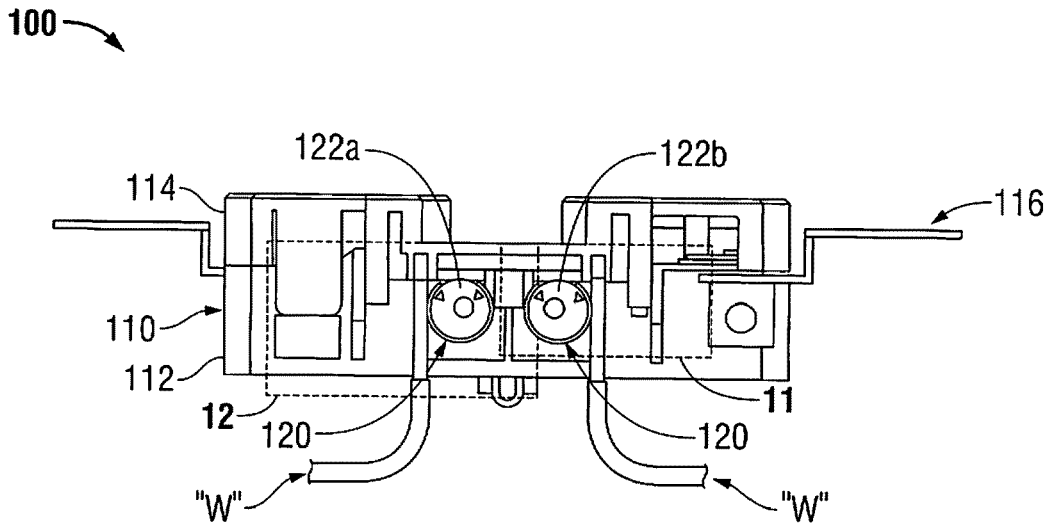
FIG. 9 is a side, elevational view of the wiring device of FIG. 8.

Turning now to FIGS. 10-12, wiring device 100 is further provided with wire maintaining features 130 that are configured and adapted to maintain the linearity of a wire "W" inserted into apertures 112*a*, 112*b* of base portion 112, to thereby ensure proper contact and/or engagement with respective cam portions 122*a*, 122*b*. As seen in FIGS. 9 and 11, wire maintaining features 130 may be in the form of collets 132 formed in an inner surface of cover portion 114 of housing 110 and preferably are axially aligned, or in registration, with apertures 112*a*, 112*b* of base portion 112. It should be understood, however, that maintaining features 130 could be any suitable mechanical feature which functions to align and/or maintain linearity of wire "W"; e.g., a recessed or keyed portion of housing 110, or the like.

Each collet 132 includes a bore 132*a* having a first cross-sectional dimension and a tapered entrance 132*b* having a cross-sectional dimension that is greater than the cross-sectional dimension of bore 132*a*. It is contemplated that entrance 132*b* of collet 132 tapers radially inward in a direction toward bore 132*a*. As so configured, as seen in FIG. 11, bore 132*a* of collet 132 is configured and dimensioned to receive and support a tip of a wire of a first gauge "W1", e.g., a 14 gauge wire, and, as seen in FIG. 12, entrance 132*b* of collet 132 is configured and dimensioned to receive and support a tip of a wire of a second larger gauge 'W2", e.g., a 12 gauge wire. As seen in FIG. 12, it is further contemplated that apertures 112*a*, 112*b* of base portion 112 is configured and dimensioned so as to frictionally hold or retain a wire of a second larger gauge "W2."

Referring now to FIGS. 1-12, a detailed discussion of the use and/or installation of a wiring device 100 will now be discussed. With wire termination mechanisms 120 in the first position (e.g., first and second cam portions 122*a*, 122*b* rotated out of the path of apertures 112*a*, 112*b*), an installer is free to insert wires "W" into apertures 112*a*, 112*b* formed in base portion 112 of housing 110.

For a multi-wire installation, an installer inserts a stripped tip or distal end of a first wire (either a relatively larger 12 gauge wire or a relatively smaller 14 gauge wire) into a selected aperture 112*a*, 112*b* of base portion. The installer advances or inserts the wire into the selected aperture 112*a*, 112*b* until either the distal tip of the relatively smaller gauge wire frictionally engages and enters into bore 132*a* of collet 132 of wire maintaining feature 130, or the distal tip of the relatively larger gauge wire is held in tapered entrance 132*b* of collet 132 of wire maintaining feature 130. As discussed above, in addition to the tapered entrance 132*b* of collet 132 of wire maintaining feature 130, the relatively larger gauge wire is also held in position due to the configuration and dimension of the aperture 112*a*, 112*b* through which it is inserted.

With at least one wire inserted into a selected aperture 112*a*, 112*b* of base portion 112, the installer then rotates the respective wire termination mechanism 120, as described above, to thereby rotate cam portions 122*a*, 122*b* into contact with the wire "W". In particular, the installer engages rotation member 124 and rotates rotation member 124 in the direction of arrow "A" (see FIG. 1) to thereby effectuate rotation of body portion 122*c* of cam 122 about the axis of rotation "X." As body portion 122*c* of cam 122 is rotated about the axis of rotation "X", the first and second cam portions 122*a*, 122*b* thereof are rotated an amount sufficient to come into electrical contact with the exposed distal end of stripped wire "W."

As described above, wire termination mechanism 120 is configured such that rotation by the installer of rotation member 124 by approximately a ¼ turn (or revolution) to approximately a ½ turn (or revolution), from the first position to the second position, effectuates contact of contact cuffs 126 of cam portions 122*a*, 122*b* with wires "W" to thereby electrically connect or electrically bridge a distal end of a wire "W" positioned within a respective aperture 118*a*$_1$, 118*a*$_2$, 118*b*$_1$, 118*b*$_2$ and a respective electrical terminal 119*a*$_1$, 119*a*$_2$, 119*b*$_1$, 119*b*$_2$.

As seen in FIGS. 11 and 12, as body portion 122*c* of cam 122 is rotated to rotate contact cuffs 126 of cam portions 122*a*, 122*b* into contact with the exposed stripped distal end of wire "W," barbs 126*a* of contact cuffs 126 engage and dig into the surface of wire "W" to thereby further draw wire "W" into the respective aperture 112 of housing 110 and/or to establish an increased electrical connection between the cam portions 122*a*, 122*b* and the wire "W." Additionally, as described above, when the wire termination mechanism 120 is in the second position, contact cuffs 126 establish an electrical connection between or electrically bridge a distal end of the wire "W" positioned within a respective aperture 118*a*$_1$, 118*a*$_2$, 118*b*$_1$, 118*b*$_2$ and a respective electrical terminal 119*a*$_1$, 119*a*$_2$, 119*b*$_1$, 119*b*$_2$.

Either prior to or following the termination of wire "W" to wiring device 100, the installer may link or separate circuits by either maintaining or removing the desired break away tabs 116*a*, 116*b*. As described above, if desired, the installer may leave in place break away tab 116*a* and/or break away tab 116*b* to thereby maintain right side upper electrical contact 118*a*$_1$ and right side lower electrical contact 118*b*$_1$ in electrical contact with one another, and thus upper and lower blade openings 114*a*, 114*b*, disposed along the right side of the wiring device, in electrical communication with one another.

Additionally or alternatively, if desired, the installer may leave in place break away tab 116*b* to thereby maintain left side upper electrical contact 118*a*$_2$ and left side lower electrical contact 118*b*$_2$ in electrical contact with one another, and thus upper and lower blade openings 114*a*, 114*b*, disposed along the left side of the wiring device, in electrical communication with one another.

Alternatively, if desired, the installer may remove break away tab 116*a* and/or break away tab 116*b* to thereby electrically isolate right side upper electrical contact 118*a*$_1$ and right side lower electrical contact 118*b*$_1$ and/or electrically isolate left side upper electrical contact 118*a*$_2$ and left side lower electrical contact 118*b*$_2$ of the wiring device 100. By removing either or both break away tabs 116*a*, 116*b*, the installer may establish discrete circuits. Again, it may be desired for both tabs 116*a* and 116*b* to be broken away, thereby resulting in the upper receptacle being isolated from the lower receptacle so that, e.g., the lower receptacle may have uninterrupted power, and the upper receptacle may be switched via a wall switch or the like.

Figure 13A:
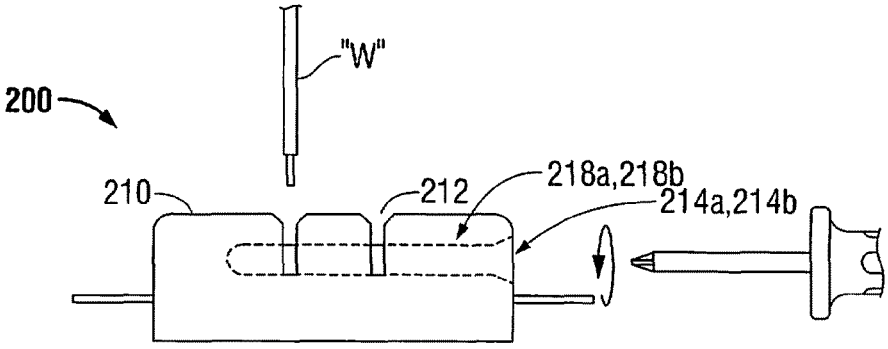
FIG. 13A is a schematic side view of an alternate embodiment of a wire termination mechanism for a wiring device according to the present disclosure.
Figure 13B:
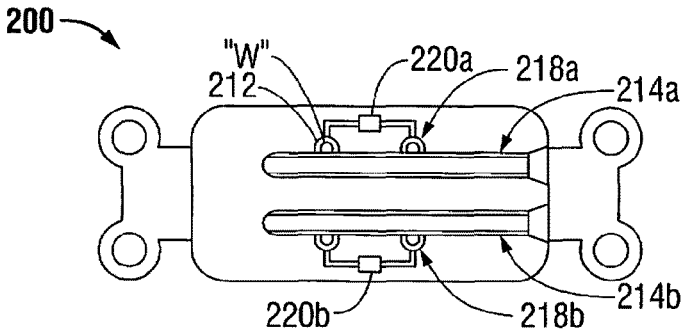
FIG. 13B is a schematic bottom view of the alternate wire termination mechanism for a wiring device as shown in FIG. 13A.
Figure 13C:
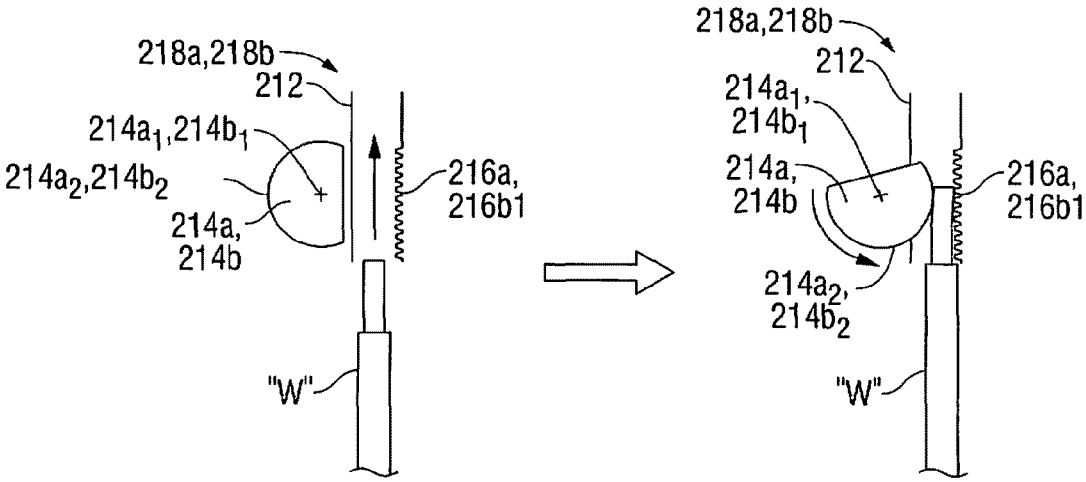
FIG. 13C is a schematic illustration of an insertion and termination of a stripped wire into the wiring device of FIGS. 13A and 13B.

Turning now to FIGS. 13A-13C, a wiring device including a wire termination mechanism according to an alternate embodiment is generally designated as 200. As seen in FIGS. 13A-13C, wiring device 200 includes a housing 210, apertures 212, and wire termination mechanisms 218*a* and 218*b*. Wire termination mechanisms 218*a* and 218*b* enable a user to more conveniently, e.g., more efficiently, terminate wires "W" to wiring device 200. Each wire termination mechanism 218*a*, 218*b* includes a rotation member 214*a*, 214*b* and a respective set of contact teeth 216*a*, 216*b*. Each rotation member 214*a*, 214*b* includes a flat side 214*a*$_1$, 214*b*$_1$ and a rounded side 214*a*$_2$, 214*b*$_2$. In an alternate embodiment, rotation members 214*a*, 214*b* could be configured to have contact teeth on one or more surfaces of the rotation member; e.g., on the flat side, on the round side, or on both or substantially both the flat and round sides. Additionally, rotation members 214*a*, 214*b* could also be adapted and configured to have a cam profile/cross-section. Even further still, the surfaces of the rotation members 214*a*, 214*b* could have formed therein grooves or channels for receiving, gripping and/or guiding wire "W". The grooves or channels could further be adapted to have varying dimensions along the length of the grooves or channels so as to first align and then grip the wire "W" and/or to accommodate wires of varying gauges.

In this manner, rotation of either rotation member 214*a*, 214*b* by the installer, by approximately ¼ turn (or revolution) to approximately ½ turn (or revolution), from the first position, wherein the flat side 214*a*$_1$, 214*b*$_1$, is aligned or in registration with the aperture, to the second position where rounded sides 214*a*$_2$, 214*b*$_2$ of rotation members 214*a*, 214*b* extend across and between respective right side and left side apertures 212, resulting in a compression/gripping of the inserted wire "W," between contact teeth 216*a*, 216*b* and a rounded side 214*a*$_2$, 214*b*$_2$ of the respective rotation member 214*a*, 214*b*.

With continued reference to FIGS. 13A-13C, wiring device 200 includes a pair of break away tabs 220*a* and 220*b*, wherein a first tab 220*a* of the pair of break away tabs is in electrical contact with right side upper electrical terminal and right side lower electrical terminal supported in housing 210 (for electrically interconnecting upper electrical contact and right side lower electrical terminal with one another). As seen in FIG. 13B, the terminal is offset and the break away tab allows the user to selectively isolate the pair of electrical contacts.

Figure 14B:
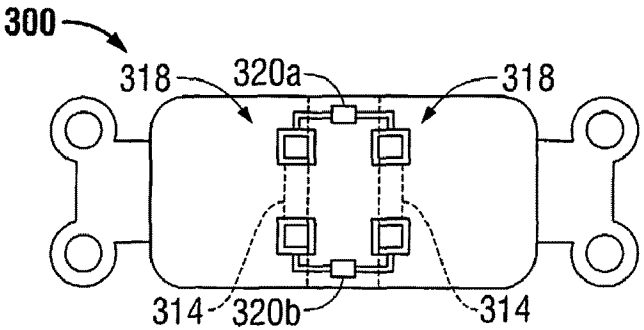
FIG. 14B is a schematic bottom view of the alternate wire termination mechanism for a wiring device as shown in FIG. 14A.
Figure 14A:
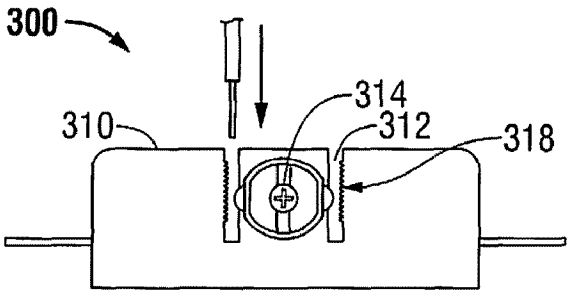
FIG. 14A is a schematic side view of an alternate embodiment of a wire termination mechanism for a wiring device according to the present disclosure.
Figure 14C:
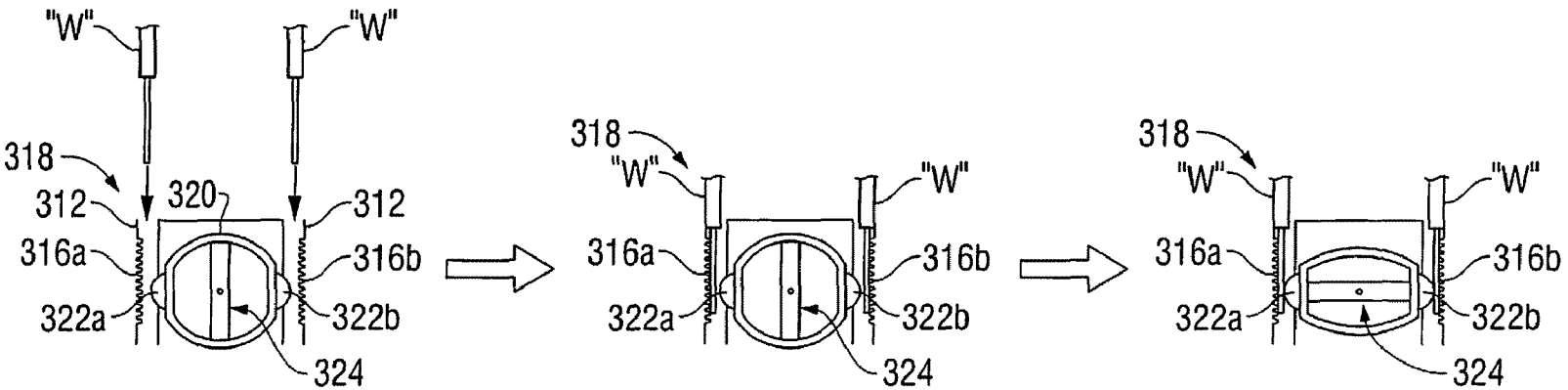
FIG. 14C is a schematic illustrating a sequence of insertion and termination of a stripped wire into the wiring device of FIGS. 14A and 14B.

In another embodiment, as seen in FIGS. 14A-14C, a wiring device including a wire termination mechanism according to an alternate embodiment is generally designated as 300. As seen in FIGS. 14A-14C, wiring device 300 includes a housing 310, apertures 312, and a wire termination mechanism 318. Wire termination mechanism 318 includes a rotation member 314 and a respective pair of contact teeth 316*a* and 316*b*. Wire termination mechanism 318 includes a resilient ring member 320 supporting a pair of opposed nubs 322*a*, 322*b* projecting therefrom, and an arm 324 rotatably disposed within ring member 320. Arm 324 is rotatable by about 90 degrees in order to effectuate contact of the nubs 322*a*, 322*b* with the stripped wire "W," resulting in the gripping of such wire "W" with contact teeth 316*a*, 316*b*. It should be noted that nubs 322*a*, 322*b* may be of any suitable shape or may even be omitted altogether. Furthermore, in embodiments incorporating nubs 322*a*, 322*b*, the surface of such nubs could be adapted to include teeth.

In this manner, rotation of the rotation member 314 of the arm 324 by the installer, by approximately 90 degrees in a clockwise or counterclockwise direction, from the first position, where the arm is parallel to the apertures 312, to the second position where the ends of the arm are in contact with the ring 320, resulting in a gripping of the inserted wire "W." between the nubs 322*a*, 322*b* and the respective pair of contact teeth 316*a* and 316*b*.

In particular, as seen in FIG. 14C, when arm 324 is oriented in a substantially parallel orientation with respect to apertures 312, arm 324 presses against ring member 320 in a manner so as to maintain nubs 322*a*, 322*b* in a retracted position and apertures 312 open. When arm 324 is rotated, approximately 90 degrees to an orientation substantially orthogonal to apertures 312, arm 324 acts on ring member 320 to extend nubs 322*a*, 322*b* into apertures 312 and thus causes wires, "W," disposed in apertures 312, to be gripped by contacts 316*a*, 316*b*, respectively.

Figure 15A:
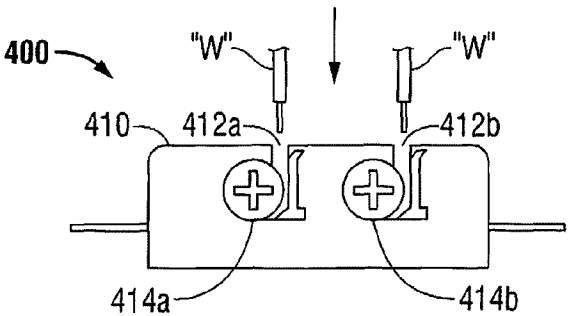
FIG. 15A is a schematic side view of an alternate embodiment of a wire termination mechanism for a wiring device according to the present disclosure.
Figure 15C:
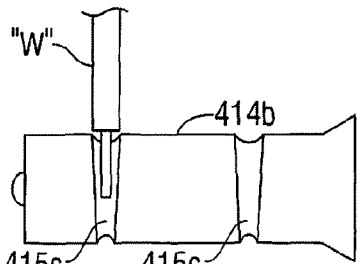
FIG. 15C is an enlarged view of the indicated area of detail of FIG. 15B.

In yet another embodiment, as seen in FIGS. 15A-15C, wiring device 400 includes a housing 410, apertures 412*a*, 412*b* and wire termination mechanisms 418*a* and 418*b*. Each wire termination mechanism 418*a* and 418*b* includes a rotation member 414*a* and 414*b* and a respective set of contact members 416*a*, 416*b*. Each rotation member 414*a* and 414*b* is preferably circular/cylindrical in shape and can be rotated at least approximately 45 degrees in order to effectuate contact between the rotation member 414*a*, 414*b* and the stripped wire "W" resulting in the gripping of such wire "W." Rotation member 414*a*, 414*b* extends across and between respective right side and left side apertures 412, resulting in a gripping of the inserted wires "W."

By way of example, each rotation member 414*a*, 414*b* includes a head 415*a*, 415*b* in the form of a screw head or other tool engaging feature. In this manner, a tool (e.g., screw driver, Allen key, or the like) may engage rotation member 414*a*, 414*b* and facilitate rotation thereof. It is further contemplated that head 415*a*, 415*b* of rotation members 414*a*, 414*b* may have a knurled outer surface or the like configured to increase gripability by the fingers of a user. Further, as illustrated in FIG. 15B, each rotation member 414*a*, 414*b* includes a pair of annular channels 415*c*, aligned with the pair of apertures 412*a*, 412*b* and tapered to facilitate engagement with and drawing in of the wire "W." It is contemplated that, in an alternate embodiment, rotation members 414*a*, 414*b* may be configured to have a cam-shaped profile or transverse cross-sectional profile and/or may be provided with teeth or the like.

Figure 16A:
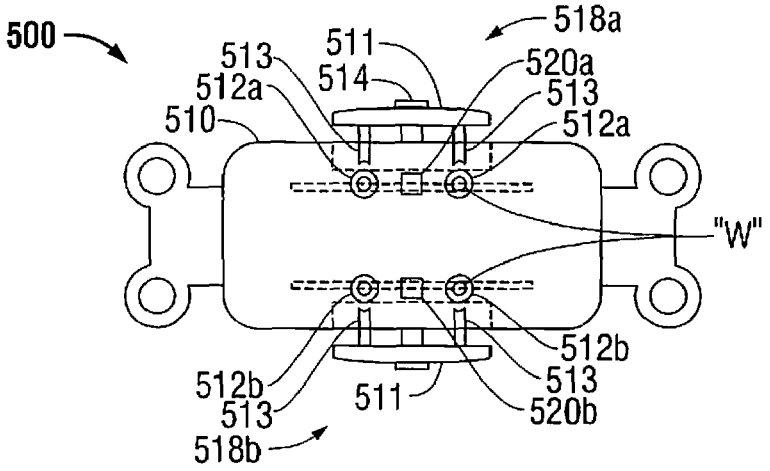
FIG. 16A is a schematic bottom view of an alternate wire termination mechanism for a wiring device as shown in a first, open position.
Figure 16B:
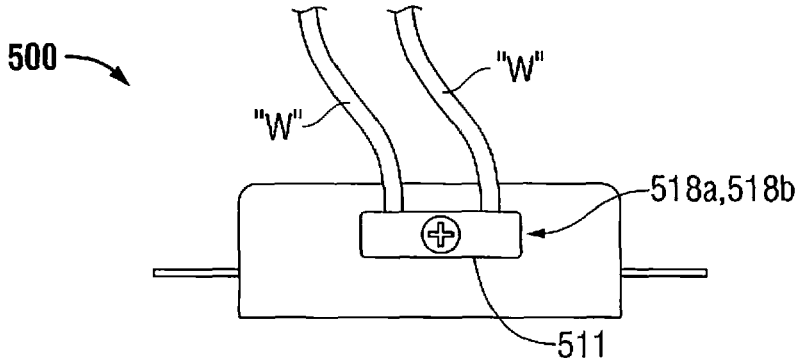
FIG. 16B is a schematic side view of an alternate embodiment of a wire termination mechanism for a wiring device according to the present disclosure.
Figure 16C:
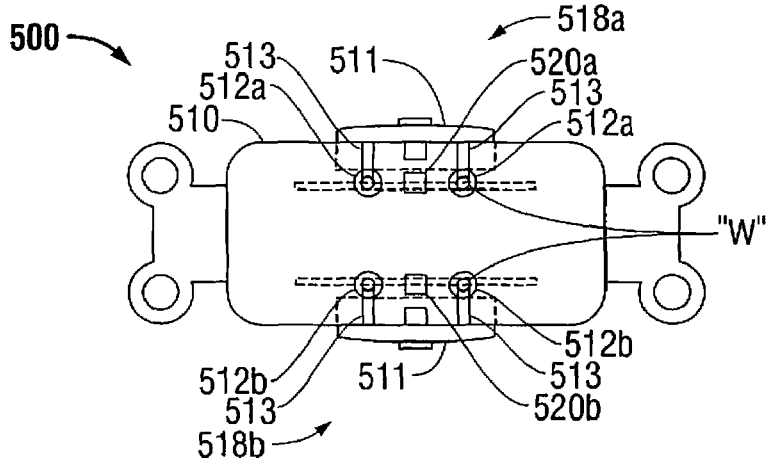
FIG. 16C is a schematic illustrating the wiring device shown in FIG. 16A with the wire termination mechanism in a second, closed position.

In yet another alternative embodiment, as seen in FIGS. 16A-16C, wiring device 500 includes a housing 510, a pair of right side apertures 512*a*, a pair of left side apertures 512*b* and respective wire termination mechanisms 518*a* and 518*b*. Each wire termination mechanism 518*a* and 518*b* includes an arm or bridge 511, a pair of fingers 513 in registration with apertures 512*a*, 512*b* and a rotation member 514 extending through bridge 511 and rotatably securable to housing 510.

Each rotation member 514 may be rotated in order to effectuate advancement and retraction of bridge 511 and, in turn, contact of fingers 513 with wires "W" and move finger 513 into contact with wires "W" and into subsequent contact with electrical contacts (not shown) within wiring device 500. In use, once the wire "W" has been inserted into the apertures 512*a*, 512*b*, rotation member 514 may be rotated to advance bridge 511 toward the housing 510 and move finger 513 into contact with wires "W" and then into bearing contact with the internal electrical contacts resulting in a gripping of the inserted wires "W." Alternatively, the ends of finger 513 could be adapted to not only bring the wire into bearing contact with internal electrical contacts but could also be used to provide further engagement/retention means; e.g., forming a "V" or other suitably shaped notch in the end of finger 513 to act as a guillotine on wire "W" (see, e.g., FIG. 16D provided in connection with the embodiment of FIGS. 16A-C).

Figure 17B:
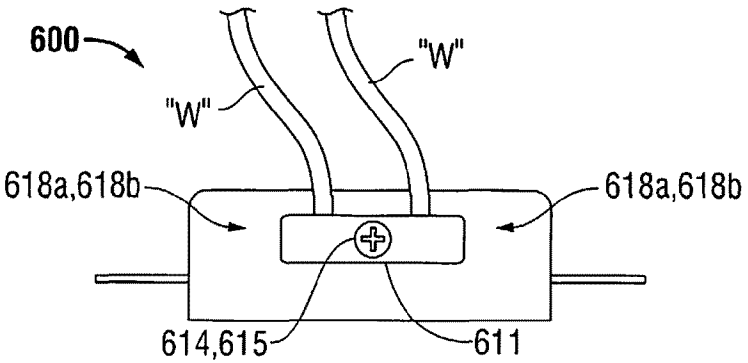
FIG. 17B is a schematic side view of the wiring device of FIG. 17A including the alternate wire termination mechanism.
Figure 17D:
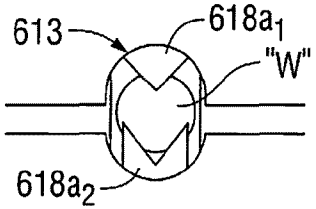
FIG. 17D is a schematic illustrating one embodiment of a retention mechanism for use with the wire termination mechanism of FIGS. 17A-D.
Figure 17A:
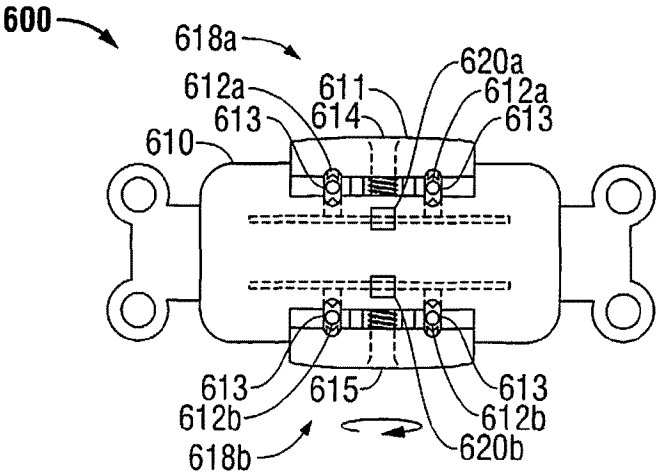
FIG. 17A is a schematic bottom view of a wiring device having an alternate wire termination mechanism in a first, open position, as shown.
Figure 17C:
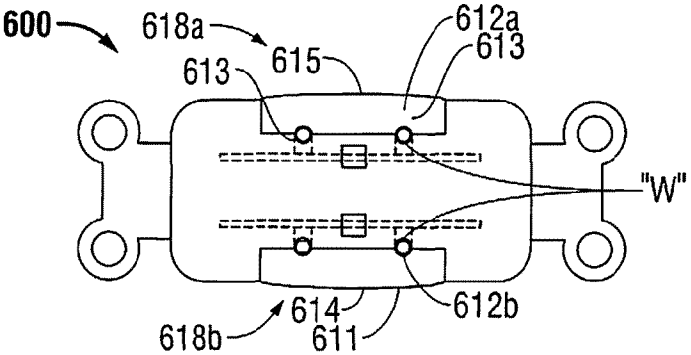
FIG. 17C is a schematic illustrating the wiring device of FIGS. 17A and 17B with the wire termination mechanism in a second, closed position.

In yet another embodiment, as seen in FIGS. 17A-17C, as an alternative to wiring device 500, wiring device 600 includes a housing 610, right side apertures 612*a* and left side apertures 612*b* and respective wire termination mechanisms 618*a* and 618*b*. Each wire termination mechanism 618*a* and 618*b* includes an arm or bridge 611, a pair of fingers 613 in registration with apertures 612*a*, 612*b* and a rotation member 614 extending through bridge 611 and rotatably securable to housing 610.

Each rotation member 614 may be rotated in order to effectuate advancement and retraction of bridge 611 and, in turn, contact of fingers 613 with wires "W" and move finger 613 into contact with wires "W." In use, once the wire "W" has been inserted into the apertures 612*a*, 612*b*, rotation member 614 may be rotated to advance bridge 611 toward the housing 610 and move finger 613 into contact with wires "W," resulting in a gripping of the inserted wires "W."

Each wire termination mechanism 618*a*, 618*b* may alternatively further include a v-shaped notch 618$a_2$, 618$b_2$ formed in a free end of each finger 613 and a complementary shaped tooth 618$a_1$, 618$b_1$ formed in contact 613. It should be understood that any suitably shaped notch may be employed in accordance with the teachings of the disclosure.

Figure 18A:
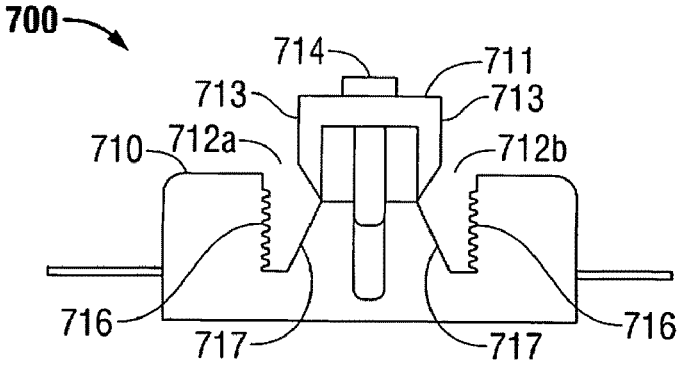
FIG. 18A is a schematic side view of an alternate wire termination mechanism for a wiring device in a first, open position, as shown.
Figure 18B:
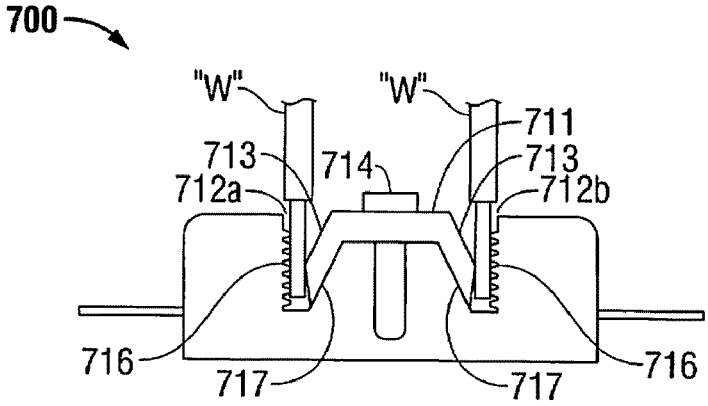
FIG. 18B is the alternate wire termination mechanism of FIG. 18A shown in a second, closed position illustrating insertion and termination of a stripped wire into the wiring device.
Figure 18C:
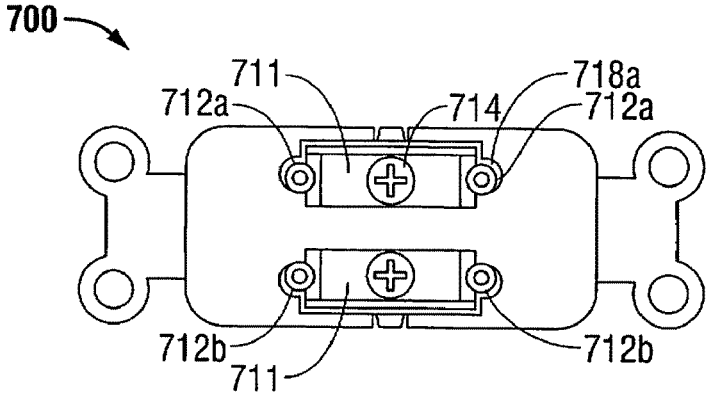
FIG. 18C is a schematic illustrating a bottom view of the wiring device of FIGS. 18A and 18B.

In yet another embodiment, as seen in FIGS. 18A-18C, wiring device 700 includes a housing 710, a pair of right side and left side apertures 712*a*, 712*b* and wire termination mechanisms 718*a* and 718*b*. Each wire termination mechanism 718*a* and 718*b* includes an arm 711, a pair of fingers 713 extending from arm 711, and a rotation member 714 extending through arm 711 for moving arm 711 toward or away from housing 710.

In operation, with wires "W" inserted into apertures 712*a*, 712*b*, the rotation member 714 is rotated in a first direction, arm 711 is moved toward housing 710 and the fingers 713 are splayed outward, against ramping surfaces 717 formed in housing 710, in order to effectuate contact with and gripping of wire "W," against contacts 716 in order to effectuate contact with and gripping of wire "W." It should be readily understood that arm 711 and/or fingers 713 are consists of any material that may be suitably selected for deforming/deflecting into/onto the desired configuration specified by ramping surfaces 717. In an alternative embodiment, the bearing surfaces of fingers 713, i.e., those surfaces that come into bearing contact with wire "W" and contacts 716, may be adapted and configured to include teeth, either integral with fingers 713 or as inserts/overlays to be applied to the bearing surfaces of fingers 713.

Figure 19A:
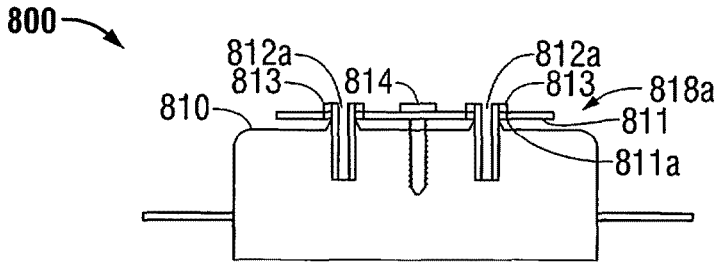
FIG. 19A is a schematic side view of an alternate embodiment of a wire termination mechanism for a wiring device according to the present disclosure.
Figure 19B:
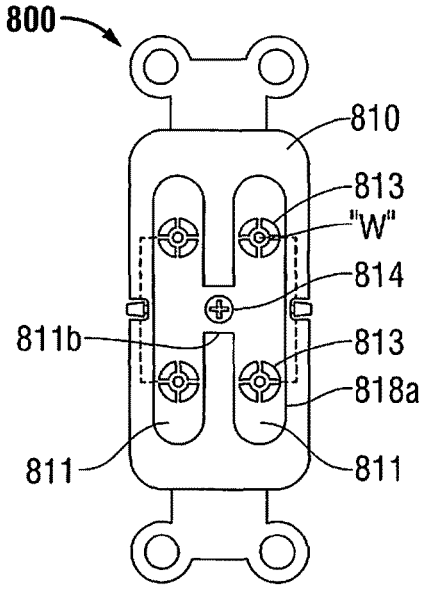
FIG. 19B is a schematic bottom view of a first alternative embodiment of the wire termination mechanism of FIG. 19A.

In yet another embodiment, as seen in FIGS. 19A-19B, wiring device 800 includes a housing 810, two pairs of spaced apart apertures 812*a* and a wire termination mechanism 818*a*. Wire termination mechanism 818*a* includes a pair of arms 811, each extending across a pair of apertures 812*a* and defining an opening 811*a* therein in registration with each aperture 812*a*, gripping members 813 (e.g., collets, as shown) extending from apertures 812*a* and through openings 811*a* formed in arms 811, and a rotation member 814 extending through a bridge 811*b* interconnecting arms 811.

Figure 19C:
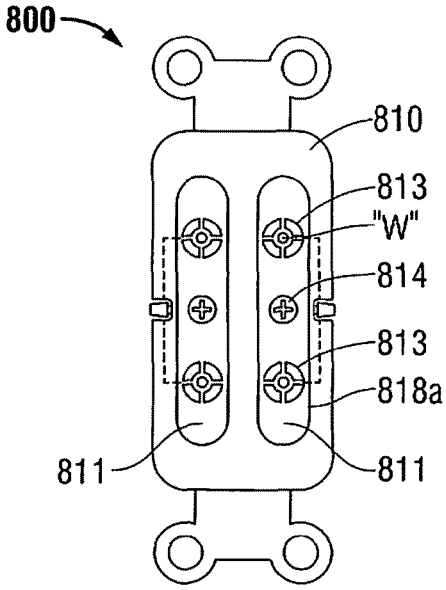
FIG. 19C is a schematic bottom view of a second alternative embodiment of the wire termination mechanism of FIG. 19A.
Figure 19D:
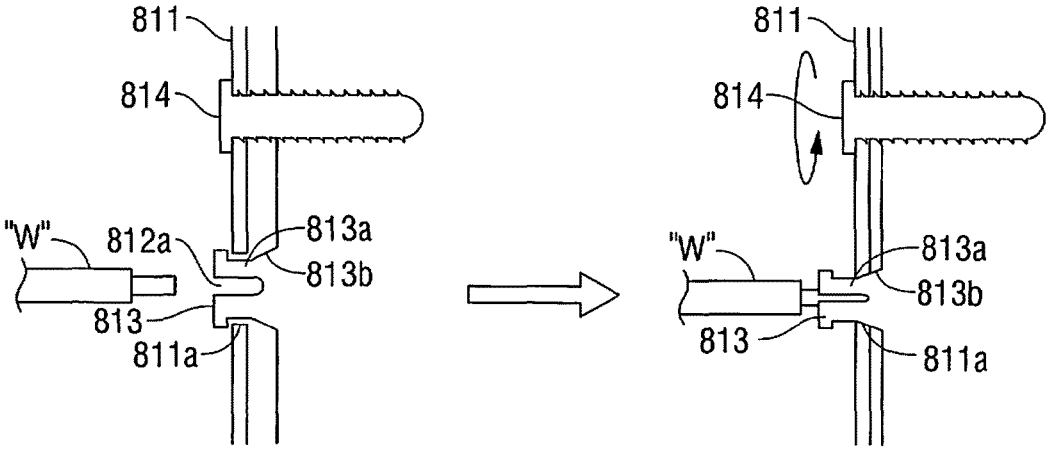
FIG. 19D is a schematic illustration of the insertion and termination of a stripped wire into the alternate wire termination mechanism of FIGS. 19A-C.

In operation, as seen in FIG. 19D, with wires "W" extending into apertures 812*a*, through gripping members 813, the rotation member 814 is rotated and arms 811 are moved toward housing 810. As arms 811 are moved toward housing 810, the edges of opening 811*a* of arms 811 act on gripping members 813 causing gripping members 813 to move radially inwards towards one another, resulting in the capturing and termination of the wire "W." Each gripping member 813 has a ramping/sloping surface 813*a* so that aperture 812*a* has a first dimension sufficient to receive wire "W" and a second dimension for cinching the wire "W." Further, each gripping member 813 may be defined by a plurality of resilient spaced apart fingers 813*b* arranged to define aperture 812*a* there through. Another embodiment is depicted in FIG. 19C, where two wire termination mechanisms 818*a* and 818*b* are provided, not connected via a bridge, with two separate rotation members 814*a*, 814*b*.

Figure 20A:
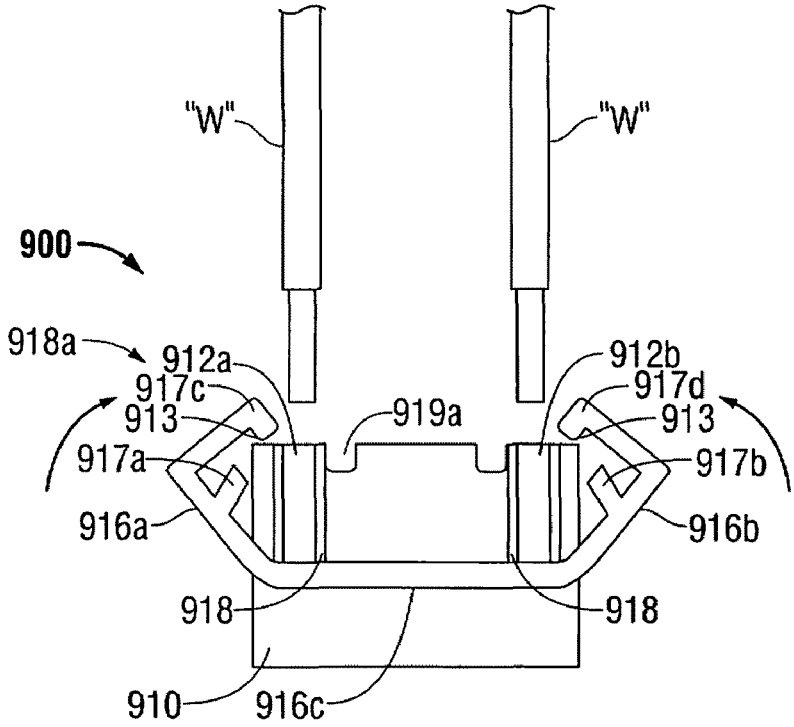
FIG. 20A is a cross-sectional view of an alternate wire termination mechanism for a wiring device in a first, open position as shown.
Figure 20B:
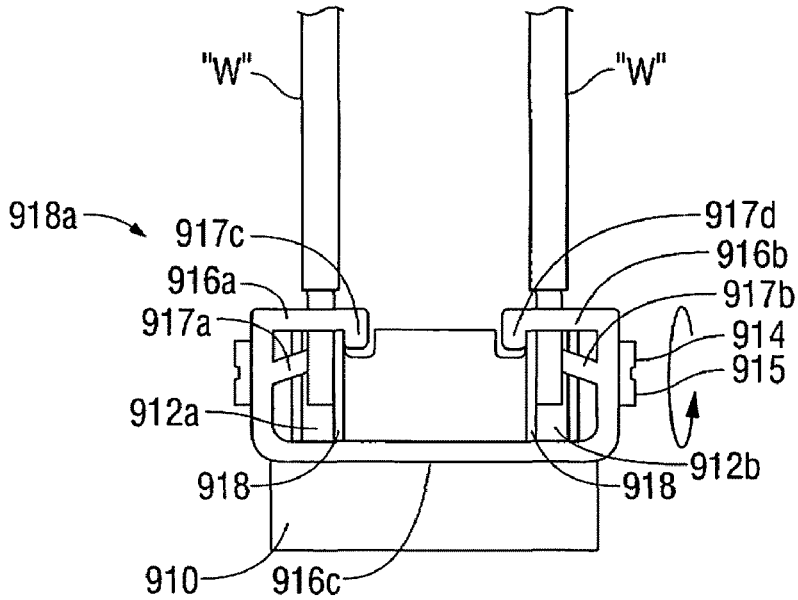
FIG. 20B is a schematic side view the wire termination mechanism of FIG. 20A shown in a second, closed position illustrating insertion and termination of a stripped wire into the wiring device of FIG. 20A.

In yet another embodiment, as seen in FIGS. 20A-20B, wiring device 900 includes a housing 910, apertures 912*a*,

912*b* and wire termination mechanism 918*a*. Wire termination mechanism 918*a* includes a pair of resilient arms 916*a*, 916*b* extending from a bridge member 916C, a first inner finger 917*a*, 917*b* extending from respective arms 916*a*, 916*b*, a second outer finger 917*c*, 917*d* extending from respective arms 916*a*, 916*b*, and a rotation member 914, extending through resilient arms 916*a*, 916*b*.

In operation of one embodiment, with arms 916*a*, 916*b* splayed outwardly from housing 910 and with wires "W" inserted into apertures 912*a*, 912*b*, the rotation members 914 are rotated, the resilient arms 916*a*, 916*b* move towards housing 910, grip wire "w" and move it into bearing relation with the internal electric contacts thereby removably securing it into place. Each finger 917*c*, 917*d* includes a lip/tooth 913 formed at a tip thereof for locking engagement in a notch 919*a*, 919*b*. As depicted in FIGS. 20A and 20B, the wire termination mechanism 918*a* may grip the wire "W" with fingers 917*c*, 917*d* on one side of the wire while fingers 917*a*, 917*b* bear on the opposite side of the wire "W" bringing the wire "W" into contact with contact pads 918.

In an alternative embodiment, with reference to FIGS. 20*a*-20*b*, arms 916*a*, 916*b* are moved toward housing 910 until lips 913 engage notches 919*a*, 919*b*. Then rotation members 914 are rotated to add increased bearing force on the wire "W" providing a larger degree of retention against the electrical contacts and also to provide a more secure locking arrangement of arms 916*a*, 916*b*, i.e., lips 913 provide a primary, more temporary locking arrangement and rotation members 914 provide a secondary, more permanent locking arrangement. It is to be understood, however, that the secondary, more permanent locking arrangement may still be disengaged, if so desired, by rotating rotation members 914 in the opposite direction.

Figure 21A:
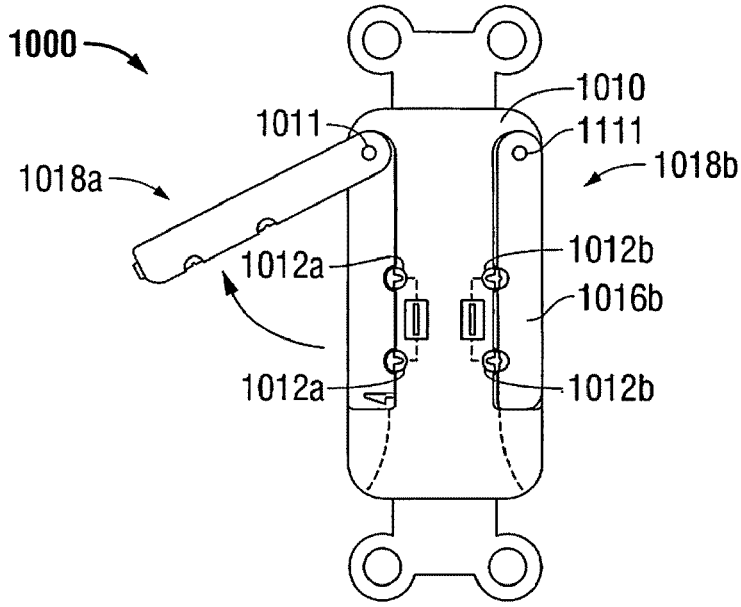
FIG. 21A is a schematic side view of an alternate embodiment of a wire termination mechanism for a wiring device according to the present disclosure.
Figure 21B:
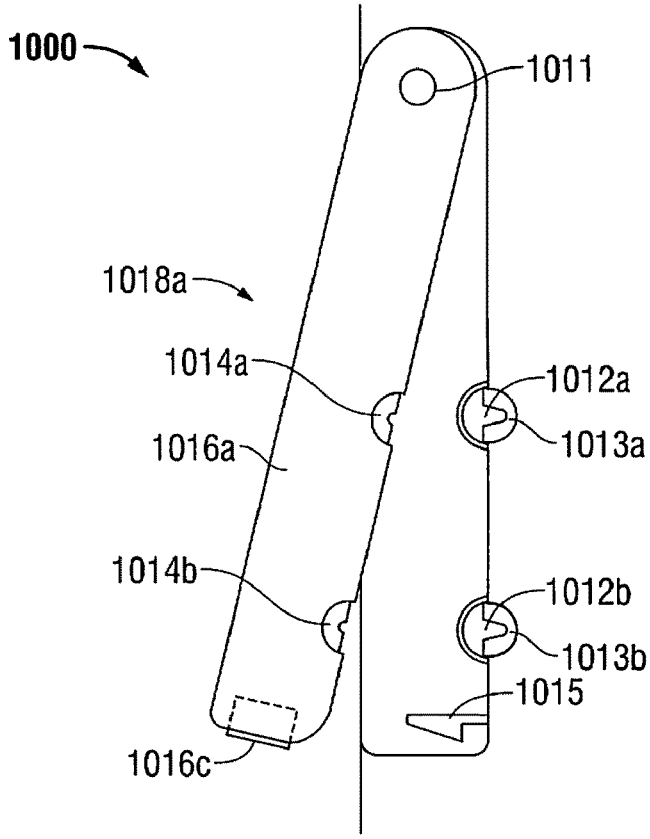
FIG. 21B is a schematic enlarged view illustrating a close up of the wire termination mechanism of FIG. 21A.

In yet another embodiment, as seen in FIGS. 21A-21B, wiring device 1000 includes a housing 1010, right side and left side apertures 1012*a*, 1012*b* and respective wire termination mechanisms 1018*a* and 1018*b*. Each wire termination mechanism 1018*a* and 1018*b* includes a lever 1016*a*, 1016*b* each defining a pair of notches/recesses 1014*a*, 1014*b* formed therein and in registration with apertures 1012*a*, 1012*b*. Each lever 1016*a*, 1016*b* is rotatable about a pivot 1011. The levers 1016*a*, 1016*b* may rotate about pivot points 1011 to retain the wire "W" secured between the recesses 1014*a* and the contact members 1013*a*, 1013*b*. Notches 1014*a*, 1014*b* may also be adapted and configured to further provide a "guillotine" engagement of wire "W," without damage to the wire.

As the levers 1016*a*, 1016*b* are rotated towards housing 1010, the recesses 1014*a*, 1014*b* move towards the contact members 1013*a*, 1013*b* and levers 1016*a*, 1016*b* may lock into engagement with a lock member 1015. Locking member 1015 may be any suitably configured mechanical arrangement that allows a feature on levers 1016*a*, 1016*b* to mechanically engage a correspondingly configured feature on housing 1010 in selective engagement. Furthermore, each lever 1016*a*, 1016*b* may include a suitably adapted and configured lock release button 1016*c* in order for the installer to unlock the lock and allow the lever to open. As depicted in FIGS. 21A and 21B, the wire termination mechanisms 1018*a* and 1018*b* may grip the wire "W" between the contact member 1013*a*, 1013*b* on one side of the wire and the recesses 1014*a*, 1014*b* on the other side, resulting in the wire "W" being removably locked into place.

Figure 22A:
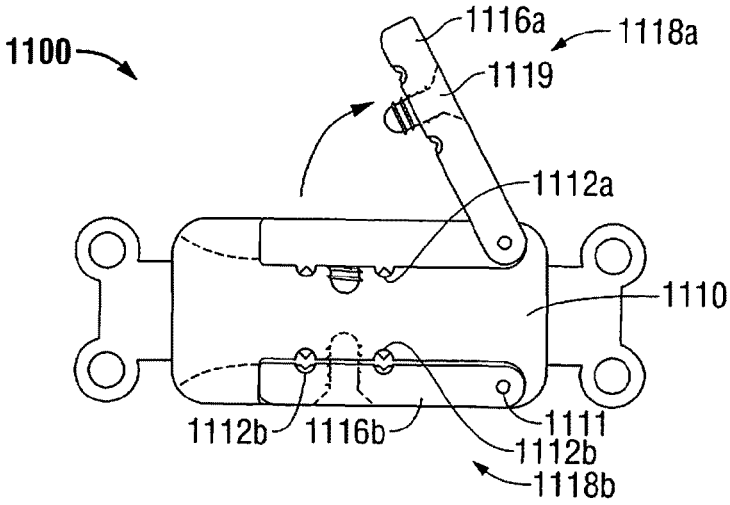
FIG. 22A is a schematic side view of an alternate embodiment of a wire termination mechanism for a wiring device according to the present disclosure.
Figure 22B:
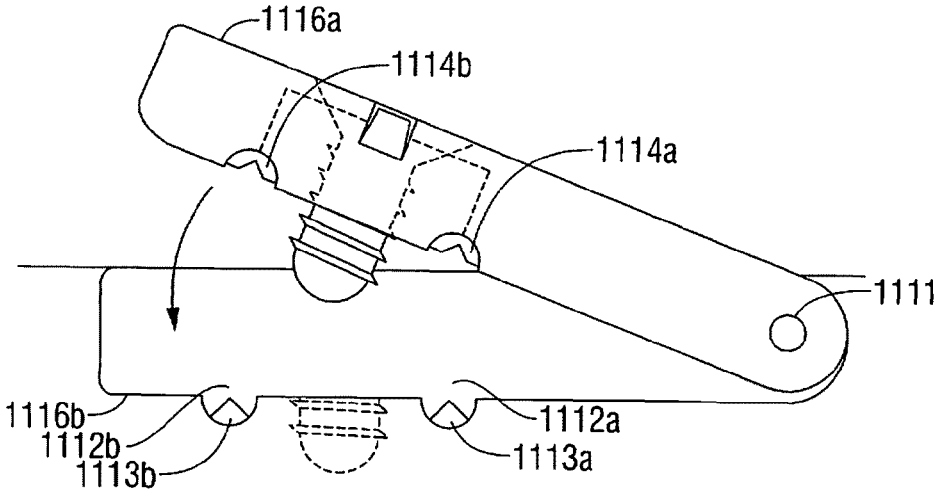
FIG. 22B is a schematic illustrating a close up of the wire termination mechanism of FIG. 22A shown in a first, open position.
Figure 22C:
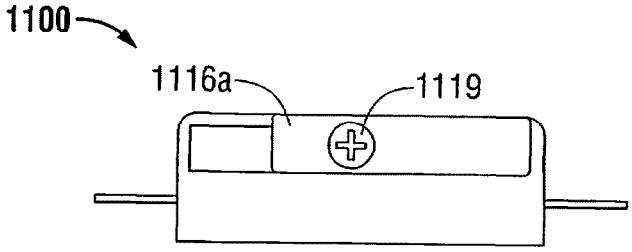
FIG. 22C is a schematic illustrating the side view of the wiring device of FIG. 22A showing the wire termination mechanism in a second, closed position.

Alternatively, the embodiment of FIGS. 21A, 21B may be adapted and configured as seen in FIGS. 22A-22C, wherein wiring device 1100 includes a housing 1110, right side and left side apertures 1112*a*, 1112*b* and respective wire termination mechanisms 1118*a* and 1118*b*. Each wire termination mechanism 1118*a* and 1118*b* includes a lever 1116*a*, 1116*b* each defining a pair of teeth 1114*a* 1114*b* formed therein and in registration with apertures 1112*a*, 1112*b*. Each lever 1116*a*, 1116*b* is rotatable about a pivot 1111. The levers 1116*a*, 1116*b* may rotate about pivot points 1111 to retain the wire "W" cinched between the teeth 1114*a*, 1114*b* and the v-shaped notches 1113*a*, 1113*b*.

As the levers 1116*a*, 1116*b* are rotated towards housing 1110, the teeth 1114*a*, 1114*b* move towards the v-shaped notches 1113*a*, 1113*b*. In operation, the installer may rotate the rotation member 1119 in order to lock the levers 1116*a*, 1116*b* into engagement with the housing 1110. As depicted in FIGS. 22A-22C, the wire termination mechanisms 1118*a* and 1118*b* may grip the wire "W" between the v-shaped notches 1113*a*, 1113*b* on one side of the wire and the teeth 1114*a*, 1114*b* on the other side, resulting in the wire "W" being locked into place.

Figure 23C:
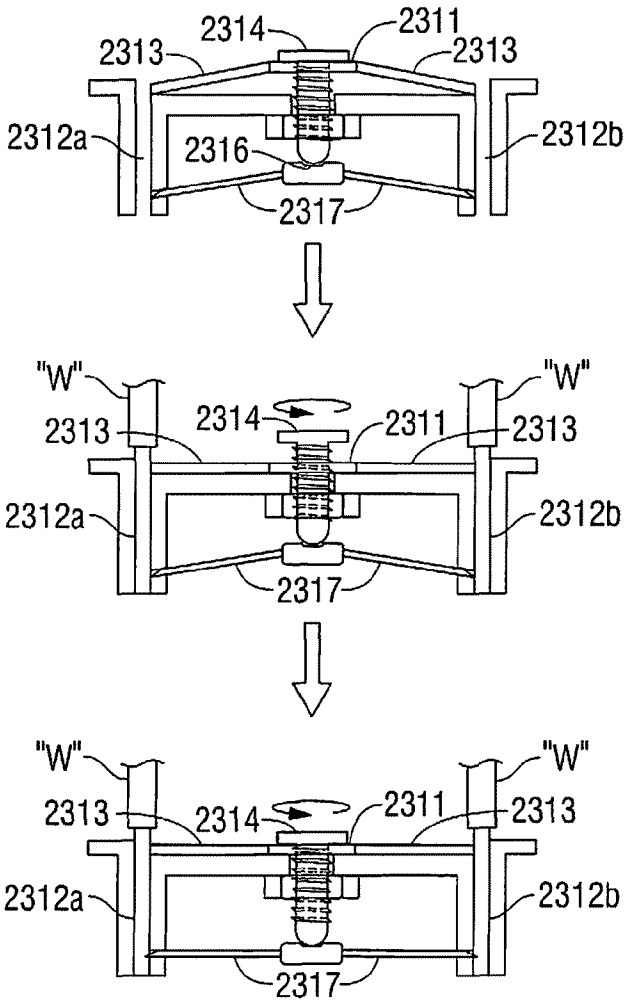
FIG. 23A is a schematic illustration of the operation of an alternate wire termination mechanism shown in three different positions depicting: a first, open position; a second, intermediary position where the stripped ends of wires are inserted into the wiring device; and a third, close position.
FIG. 23B is a schematic bottom view of an alternate embodiment of the wire termination mechanism for a wiring device as shown in FIG. 23A.
Figure 23A:
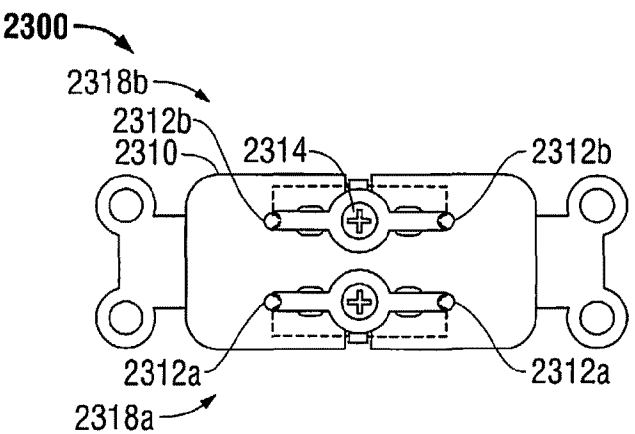
Figure 23B:
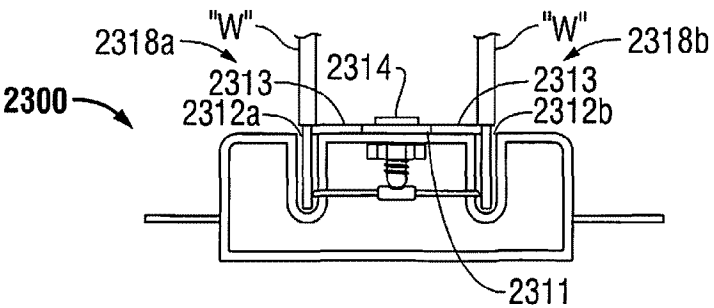

In yet another embodiment, as seen in FIGS. 23A-23C, wiring device 1200 includes a housing 2310, a pair of right side and left side apertures 2312*a*, 2312*b* and wire termination mechanisms 2318*a* and 2318*b*. Each wire termination mechanism 2318*a* and 2318*b* includes an arm or bridge 2311, a pair of fingers 2313 extending from arm 2311 and a rotation member 2314 extending through arm 2311 for moving arm 2311 toward or away from housing 2310.

In operation, with wires "W" inserted into apertures 2312*a*, 2312*b*, the rotation member 2314 is rotated in a first direction, arm 2311 and fingers 2313 are moved towards housing 2310 until they are parallel to the housing 2310. FIG. 23C depicts the wire termination mechanisms 2318*a*, 2318*b* in a first position, a second position where the rotation member 2314 is further rotated towards housing and respective notch 2316 until the bridge 2311 and fingers 2313 are flat and parallel to the housing 2310, and a third position, where the wire "W" is cinched in the apertures 2312*a*, 2312*b*.

Figure 24A:
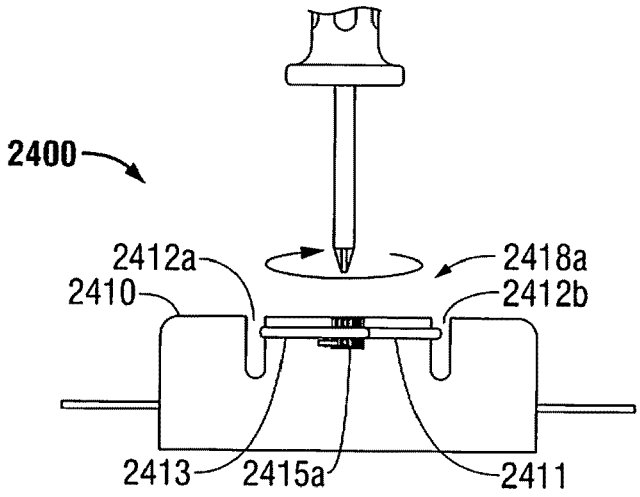
FIG. 24A is a schematic side view of an alternate embodiment of a wire termination mechanism for a wiring device according to the present disclosure.
Figure 24B:
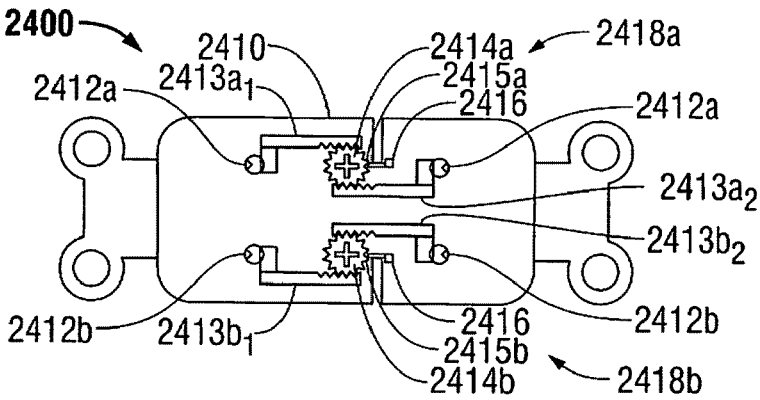
FIG. 24B is a schematic bottom view of the wiring device shown in FIG. 24A illustrating one embodiment of the rack and pinion wire termination mechanism.
Figure 24C:
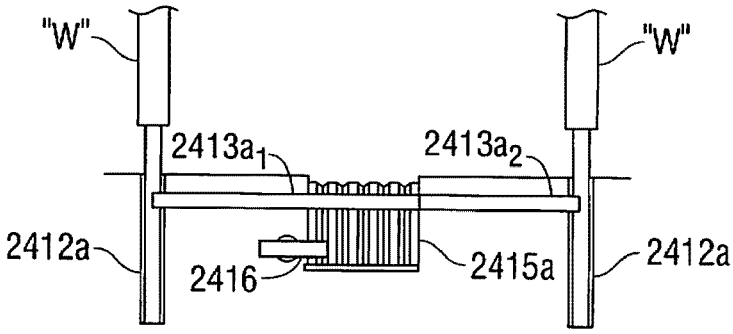
FIG. 24C is a cross-sectional schematic illustration of the insertion and termination of a stripped wire into the wire termination mechanism of FIGS. 24A and 24B.

In yet another embodiment, as seen in FIGS. 24A-24C, wiring device 2400 includes a housing 2410, a pair of right side and left side apertures 2412*a*, 2412*b* and wire termination mechanisms 2418*a* and 2418*b*. Each wire termination mechanism 2418*a* and 2418*b* includes a rack 2413$a_1$, 2413$a_2$, 2413$b_1$, 2413$b_2$, a pinion 2415*a*, 2415*b* supported on a rotation member 2414*a*, 2414*b* extending between respective racks 2413$a_1$, 2413$a_2$, 2413$b_1$, 2413$b_2$, for moving racks 2413$a_1$, 2413$a_2$, 2413$b_1$, 2413$b_2$, toward or away from apertures 2412*a*, 2412*b*. A ratchet 2416 may be provided and be engageable with pinions 2415*a*, 2415*b* for maintaining the relative position of pinions 2415*a*, 2415*b* and racks 2413$a_1$, 2413$a_2$, 2413$b_1$, 2413$b_2$. It should be readily understood that pinion 2415*a*,2415*b* may be adapted and configured to integrally include rotation member 2414*a*,2414*b*, i.e., pinion 2415*a*,2415*b*, as a single unitary member, is adapted and configured to perform the function of the rotation member as well.

In operation, with racks 2413$a_1$, 2413$a_2$, 2413$b_1$, 2413$b_2$, withdrawn, wires "W" are inserted into apertures 2412*a*, 2412*b*, and the rotation member 2414*a*, 2414*b* are rotated in a first direction. As rotation members 2414*a*, 2414*b* are rotated in the first direction so to are pinions 2415*a*, 2415*b*, thus causing respective racks 2413$a_1$, 2413$a_2$, 2413$b_1$, 2413$b_2$, to move towards apertures 2412*a*, 2412*b* until they are engaged with wires "W". It is understood that if rotation member 2414*a*, 2414*b* is rotated in a direction opposite to the first direction, while wires "W" are inserted in apertures 2412*a*, 2412*b*, then wires "W" will be released from apertures 2412*a*, 2412*b*.

Figure 25A:
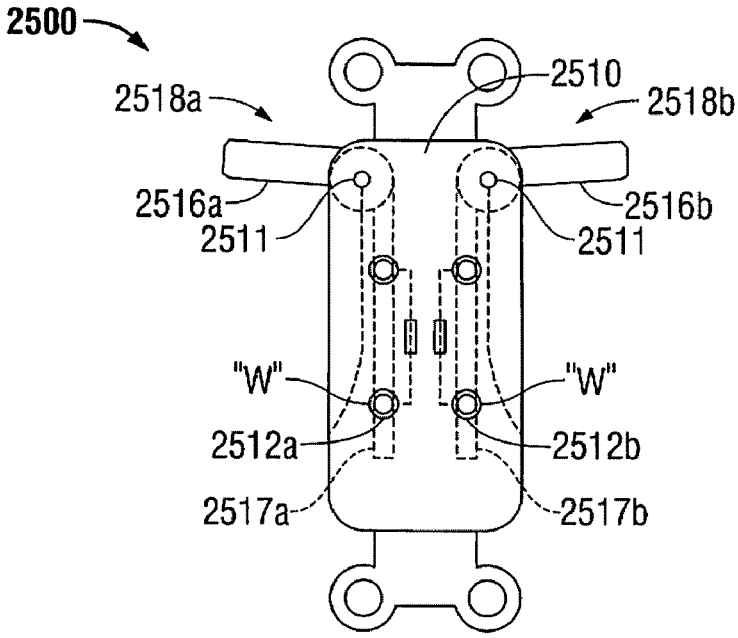
FIG. 25A is a schematic plan view of an alternate wire termination mechanism for a wiring device according to the present disclosure, shown in a first, open position.
Figure 25B:
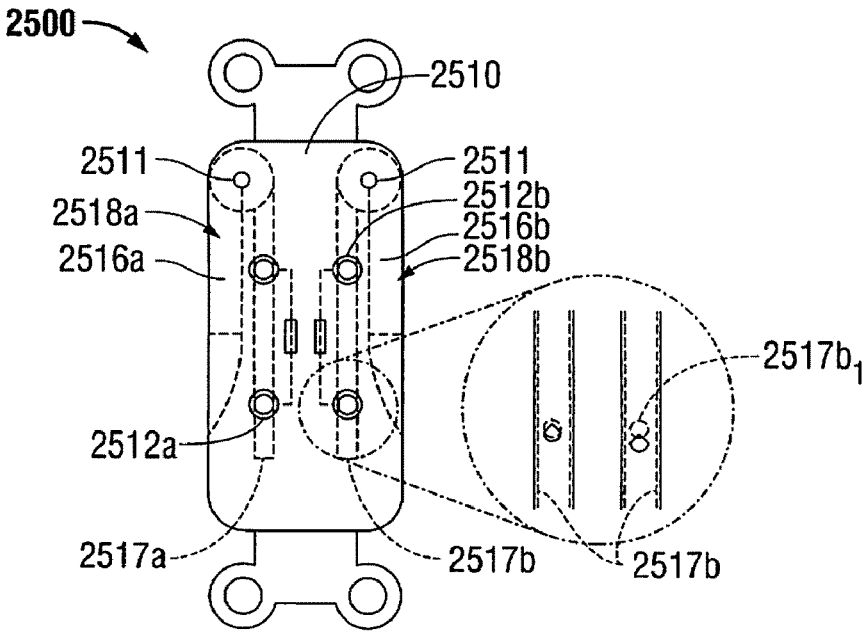
FIG. 25B is a schematic plan view of the wiring device of FIG. 25A, shown with the wire termination mechanism in a second, closed position.

In another embodiment, as seen in FIGS. 25A-25B, wiring device 2500 includes a housing 2510, right side and left side apertures 2512*a*, 2512*b* and respective wire termination mechanisms 2518*a* and 2518*b*. Each wire termination mechanism 2518*a* and 2518*b* includes an insulative lever 2516*a*, 2516*b* pivotally secured to housing 2510 via a pivot 2511. Each wire termination mechanism 2518*a* and 2518*b* further includes a conductive tail 2517*a*, 2517*b* connected to a respective lever 2516*a*, 2516*b* and extending across respective right side and left side apertures 2512*a*, 2512*b*. Each tail 2517*a*, 2517*b* defines a pair of apertures 2517$a_1$, 2517$b_1$ formed therein. The apertures are spaced a distance from one another equal to the relative distances that right side and left side apertures 2512*a*, 2512*b* are spaced from one another. The levers 2516*a*, 2516*b* may rotate about pivot points 2511 to translate tails 2517*a*, 2517*b* and contact or terminate a wire "W" disposed within right side and left side apertures 2512*a*, 2512*b* in, e.g., common guillotine fashion without damage to the wire.

In use, with levers 2516*a*, 2516*b* in the open condition, as seen in FIG. 25A, and apertures 2517$a_1$, 2517$b_1$ of tails 2517*a*, 2517*b* in registration with right side and left side apertures 2512*a*, 2512*b*, wires "W" may be inserted therein. Once wires "W" are inserted, levers 2516*a*, 2516*b* may be actuated to the closed, thus drawing tails 2517*a*, 2517*b* through housing 2510 and un-aligning apertures 2517$a_1$, 2517$b_1$ of tails 2517*a*, 2517*b* from right side and/or left side apertures 2512*a*, 2512*b*. In this manner, tails 2517*a*, 2517*b* are brought into gripping contact with wires "W".

Figure 26A:
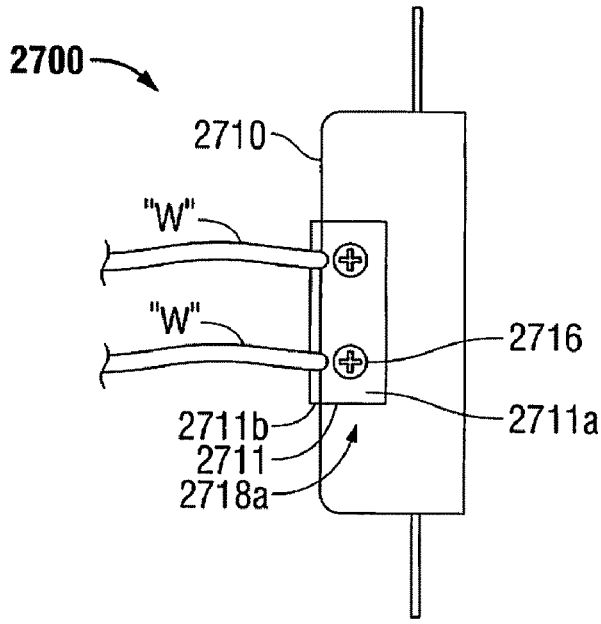
FIG. 26A is a schematic side elevational view of still another embodiment of a wire termination mechanism for a wiring device according to the present disclosure.
Figure 26B:
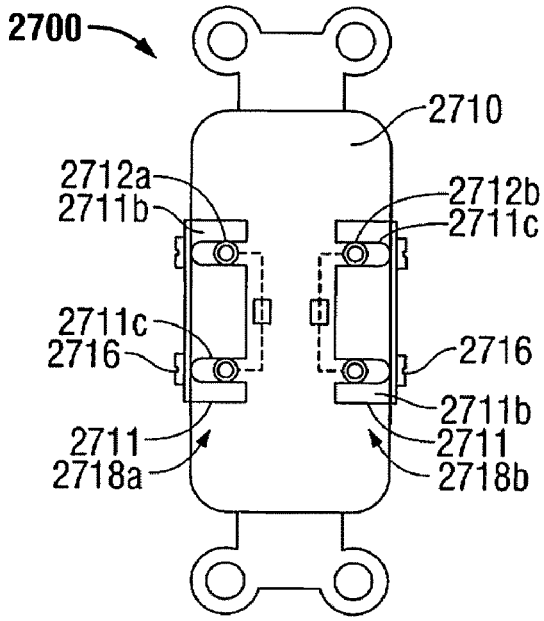
FIG. 26B is a schematic bottom plan view of the wiring device of FIG. 26A.

Turning now to FIGS. 26A and 26B, a wiring device 2700, including a wire termination mechanism according to still another embodiment of the present disclosure, is provided. As seen in FIGS. 26A and 26B, wiring device 2700 includes a housing 2710, right side apertures 2712*a* and left side apertures 2712*b* and respective wire termination mechanisms 2718*a* and 2718*b*. Each wire termination mechanism 2718*a* and 2718*b* includes a bridge 2711 extending across the respective pair of right side apertures 2712*a* and left side apertures 2712*b*. Each bridge 2711 has a side plate 2711*a* and a back plate 2711*b*. At least one rotation member 2714 may extend through side plate 2711*a* to secure or connect bridge 2711 to housing 2710. Each rotation member 2714 may be rotated in order to effectuate advancement and retraction of bridge 2711 and, in turn, contact of back plate 2711*b* of bridge 2711 with wires "W." Each back plate 2711*b* includes a pair of slots 2711*c* formed therein that are in registration with the respective right side apertures 2712*a* and left side apertures 2712*b*.

While a single bridge 2711 is shown for engaging or cooperating with the pair of right side apertures 2712*a* and left side apertures 2712*b*, it is contemplated that each aperture 2712*a*, 2712*b* of the pairs of apertures, may have a discrete bridge associated therewith.

In use, once wires "W" have been inserted into the apertures 2712*a*, 2712*b*, rotation members 2714 may be rotated to advance bridge 2711 toward housing 2710 and move back plate 2711*b* of bridge 2711 into contact with wires "W," resulting in a gripping of the inserted wires "W."

While at least one embodiment of the disclosure has been shown in the drawings and/or discussed herein, it is not intended that the present disclosure be limited thereto, as it is intended that the present disclosure be as broad in scope as the art will allow and that the specification be read likewise. Therefore, the above description should not be construed as limiting, but merely as an exemplification of a particular embodiment.

What is claimed is:

1. A wiring device for installation in and connection to a junction box, the wiring device, comprising:

a housing having at least one aperture configured to receive a distal end of a wire therein, the aperture being in registration with a wire path, the housing being adapted and configured to removably mount the wiring device in the junction box;

an electrical contact at least partially disposed within the housing and in registration with the wire path; and a wire termination mechanism comprising a body portion having an axis of rotation and at least one eccentric cam portion, the wire termination mechanism being rotationally supported by the housing and at least partially disposed therein, and wherein the wire termination mechanism is configured to selectively secure the distal end of the wire and includes at least a first position in which the wire termination mechanism allows the insertion or removal of the wire and at least a second position in which the wire termination mechanism secures the wire in electrical communication with the electrical contact.

2. The wiring device according to claim 1, wherein the wire termination mechanism terminates the distal end of the wire against the respective electrical contact upon an actuation thereof from the first position to the second position.

3. The wiring device according to claim 1, wherein each wire termination mechanism terminates the distal end of the wire upon approximately a ¼ to approximately a ½ revolution.

4. The wiring device according to claim 1, wherein upon rotation of the wire termination mechanism, an outer surface of the eccentric cam portion selectively contacts a surface of the distal end of a wire.

5. The wiring device according to claim 4, further comprising at least one projection extending from the outer surface of the eccentric cam portion so as to selectively engage the distal end of a wire.

6. The wiring device according to claim 1, further comprising a collet in registration with each aperture, wherein each collet is configured to support a distal end of a wire inserted therein.

7. The wiring device according to claim 6, wherein the collet has a bore having a first dimension and a second dimension, the first dimension configured to support a distal end of a wire of a first dimension, and the second dimension configured to support a distal end of a wire of a second dimension.

8. The wiring device according to claim 1, wherein the wiring device is selected from the group consisting of an electrical receptacle, a duplex electrical receptacle, a switch, a lighting fixture, a ground fault circuit interrupter, an arc fault circuit interrupter, a dimmer, a communication device, a fan speed control, an occupancy sensor, an energy management device, and a surge suppressor.

9. A method of terminating a wire to a wiring device that is configured to be installed in and connected to a junction box, the method comprising the steps of:

inserting a distal end of the wire into an aperture of the wiring device;

rotating a wire termination mechanism having a cam portion to a securing position;

wherein the rotation of the wire termination mechanism causes a surface of the cam portion to selectively engage the distal end of the wire and establish electrical communication between the wire and the wiring device; and removably mounting the housing of the wiring device in the junction box.

10. The method according to claim 9, wherein the step of rotating comprises rotating the wire termination mechanism approximately a ¼ to ½ revolution.

11. The method according to claim 9, further comprising the step of receiving the distal end of the wire within a collet.

12. The method according to claim 11, wherein the collet stops the distal end of the wire at a predetermined location based on the gauge of the wire.

13. A wiring device for installation in and connection to a junction box, the wiring device, comprising:

a housing defining at least a pair of apertures each configured to receive a distal end of a wire therein, each aperture being in registration with a wire path, the housing being adapted and configured to removably mount the wiring device in the junction box;

an electrical contact at least partially disposed within the housing and in registration with each wire path; and a wire termination mechanism at least partially disposed within the housing and extending across the pair of apertures, wherein the wire termination mechanism is configured to simultaneously selectively secure the distal end of each wire upon a rotation thereof, wherein the wire termination mechanism includes at least a first position in which the wire termination mechanism allows the insertion or removal of the wires and at least a second position in which the wire termination mechanism secures the wires in electrical communication with the electrical contact.

14. A wiring device for installation in and connection to a junction box, the wiring device, comprising:

a housing defining an aperture configured to receive a distal end of a wire therein, the aperture being in registration with a wire path, the housing being adapted and configured to removably mount the wiring device in the junction box;

an electrical contact at least partially disposed within the housing and in registration with the wire path; and wire termination means at least partially disposed within the housing for selectively securing the distal end of the wire, wherein the wire termination means includes at least a first position in which the wire termination means allows the insertion or removal of the wire and at least a second position in which the wire termination means secures the wire in electrical communication with the electrical contact.

15. The wiring device according to claim 14, wherein the wiring device is selected from the group consisting of an electrical receptacle, a duplex electrical receptacle, a switch, a lighting fixture, a ground fault circuit interrupter, an arc fault circuit interrupter, a dimmer, a communication device, a fan speed control, an occupancy sensor, an energy management device, and a surge suppressor.

16. A wire termination mechanism for terminating a wire to a wiring device that is configured for installation in and connection to a junction box, wherein the wiring device is selected from the group consisting of an electrical receptacle, a duplex electrical receptacle, a switch, a lighting fixture, a ground fault circuit interrupter, an arc fault circuit interrupter, a dimmer, a communication device, a fan speed control, an occupancy sensor, an energy management device, and a surge suppressor, and wherein the wiring device is adapted and configured to be removably mounted in the junction box, the wire termination mechanism comprising:

a body portion having an axis of rotation and at least one eccentric cam portion, the wire termination mechanism being rotationally supported in the wiring device, wherein the wire termination mechanism is configured to selectively secure a distal end of the wire and includes at least a first position in which the wire termination mechanism allows the insertion or removal of the wire into/from the wiring device and at least a second position in which the wire termination mechanism secures the wire in electrical communication with an electrical contact of the wiring device.

17. A wire termination mechanism for selectively securing a distal end of a wire to a wiring device that is configured for installation in and connection to a junction box, wherein the wiring device is selected from the group consisting of an electrical receptacle, a duplex electrical receptacle, a switch, a lighting fixture, a ground fault circuit interrupter, an arc fault circuit interrupter, a dimmer, a communication device, a fan speed control, an occupancy sensor, an energy management device, and a surge suppressor, and wherein the wiring device is adapted and configured to be removably mounted in the junction box, the wire termination mechanism comprising:

a cam having a body portion defining an axis of rotation extending in a direction transverse to an insertion axis of an aperture of the wiring device configured to receive the distal end of the wire; and at least one eccentric cam portion supported on the body portion of the cam and in registration with the at least one aperture, wherein the cam portion is movable to and away from the at least one aperture upon a rotation of the body portion.

* * * * *